US007300531B2

(12) United States Patent
Bradshaw et al.

(10) Patent No.: US 7,300,531 B2
(45) Date of Patent: Nov. 27, 2007

(54) TAPE APPLICATION DEVICE

(75) Inventors: Dennis A. Bradshaw, Clackamas, OR (US); Michael J. Prue, Milwaukie, OR (US); Yang Tri Lai, Tigard, OR (US); Raymond P. Saranto, LaCenter, WA (US)

(73) Assignee: Adalis Corporation, Vancouver, WA (US)

( * ) Notice: Subject to any disclaimer, the term of this patent is extended or adjusted under 35 U.S.C. 154(b) by 288 days.

(21) Appl. No.: 10/970,556

(22) Filed: Oct. 20, 2004

(65) Prior Publication Data

US 2006/0081321 A1 Apr. 20, 2006

(51) Int. Cl.

| | |
|---|---|
| ***B32B 37/22*** | (2006.01) |
| ***B32B 41/00*** | (2006.01) |
| ***B26D 5/32*** | (2006.01) |
| ***B31F 5/06*** | (2006.01) |

(52) U.S. Cl. ..... 156/64; 156/270; 156/304.3; 156/355; 156/361; 156/522; 156/552; 156/553

(58) Field of Classification Search ..... 156/270, 156/304.3, 522, 552, 553, 560; 493/382
See application file for complete search history.

(56) References Cited

U.S. PATENT DOCUMENTS

| | | | | |
|---|---|---|---|---|
| 1,977,199 | A | 10/1934 | Osgood | |
| 2,028,341 | A * | 1/1936 | Isobel et al. | 229/69 |
| 2,538,520 | A * | 1/1951 | Holt, Jr. et al. | 156/82 |
| 2,574,181 | A * | 11/1951 | Hess | 156/351 |
| 2,625,287 | A * | 1/1953 | Holt, Jr. et al. | 156/359 |
| 3,490,974 | A | 1/1970 | Jacobson | |
| 3,540,969 | A * | 11/1970 | Jorgensen | 156/523 |
| 3,607,562 | A | 9/1971 | Brenneman et al. | |
| T0,896,014 | I4 * | 3/1972 | Huffaker et al. | 428/61 |
| 3,705,829 | A | 12/1972 | Brenneman et al. | |
| 3,988,192 | A * | 10/1976 | Landis et al. | 156/267 |
| 4,002,009 | A * | 1/1977 | Tolosa et al. | 53/296 |
| 4,042,440 | A * | 8/1977 | Hasegawa et al. | 156/304.1 |
| 4,044,182 | A | 8/1977 | Aizawa | |
| 4,087,312 | A * | 5/1978 | Maltese | 156/552 |
| 4,227,955 | A * | 10/1980 | Woods et al. | 156/269 |
| 4,925,521 | A * | 5/1990 | Asbury et al. | 156/517 |
| 5,045,144 | A * | 9/1991 | Bonemi | 156/361 |
| 5,346,574 | A | 9/1994 | Tamura et al. | |
| 6,358,356 | B1 | 3/2002 | Bradshaw et al. | |
| 6,368,449 | B1 | 4/2002 | Bradshaw et al. | |
| 6,537,406 | B1 * | 3/2003 | Jensen et al. | 156/202 |
| 6,557,795 | B1 | 5/2003 | Ohshio et al. | |

* cited by examiner

*Primary Examiner*—Mark A Osele
(74) *Attorney, Agent, or Firm*—Klarquist Sparkman, LLP

(57) ABSTRACT

A device and a method for applying tape to one or more sheets of material in a moving line-up. The device can include a tape applicator, a sensor, a tape cutter, a tape gripper, an engagement-initiation press, and a hold-down portion. During intermittent operation, the tape applicator is moved away from the sheets of material causing an unattached tape portion to extend from the tape applicator to a final connection point on the sheets of material. The tape cutter and the tape gripper are configured to cut and grip the unattached tape portion. As tape application is restarted, the engagement-initiation press is lowered to hold the end of the tape in place. The hold-down portion prevents the sheets of material from shifting out of alignment as tape is applied by the tape applicator. The sensor can be used, for example, to detect gaps between the sheets of material.

55 Claims, 13 Drawing Sheets

TAPE APPLICATION DEVICE

FIELD

This disclosure concerns methods and apparatus for applying tape to thin sheets of material, such as to connect sheets of material in the manufacture of plywood and laminated veneer lumber.

BACKGROUND

Plywood and laminated veneer lumber are composite products formed by stacking thin sheets of wood veneer called plies. A sheet of plywood typically comprises a facing ply, a backing ply, and one or more core plies positioned between the facing ply and the backing ply. The core plies are not visible on the finished product, so they often are made of lower grade wood than the facing ply and the backing ply. Also, because the core plies are sandwiched between other plies, they do not need to be continuous. The core plies in many plywood products are formed from small pieces laid edge-to-edge. These pieces can be referred to as core pieces.

Plywood products typically are manufactured in standard sizes, such as 101 inches by 54 inches. Core plies matching the size of the desired product can be manufactured by lining up core pieces edge-to-edge to form a continuous sheet and then cutting that sheet into plies of a predetermined size. Some plywood manufacturing processes begin with a bottom layer of facing plies or backing plies lined up edge-to-edge. Each facing ply or backing ply is a continuous sheet with dimensions matching the dimensions of the desired final product. Adhesive, such as uncured phenolic resin, is applied to the bottom layer by one of a variety of methods (e.g., spraying, foaming, rolling or extruding). Core pieces then are placed edge-to-edge on the bottom layer. Adhesive is applied to each layer of core pieces before the next layer is added. After the final layer is added, the line of stacked plies is cut to size with a cross cut saw. The resulting sections are sent to a prepress where they are staged before entering a final hot press. In the final hot press, the stacked plies are heated and pressed to activate the adhesive and bond the plies.

Since core pieces typically have random lengths and must be cut into plies of a predetermined size, it is possible to have very narrow core pieces adjacent to the ends of the product before it is pressed. Sometimes, when the end pieces are very narrow, the adhesive is not strong enough to hold them in place. A plywood panel with a missing end piece is referred to as having a "narrow core." Plywood panels with narrow cores are classified as "off grade" and are sold at lower prices than "on grade" panels.

Several references have suggested unifying the core pieces by various methods. For example, U.S. Pat. No. 1,977,199 discloses "passing the successive crossing strips, before they are coated with glue, through a machine which will fasten them together into one continuous sheet by gluing each strip to a pair of continuous strings or tapes . . . . " See U.S. Pat. No. 1,977,199 at column 2, lines 68-76. Similarly, U.S. Pat. No. 4,044,182 discloses forming "veneer core blocks for plywood . . . by sewing green veneer strips which are closely contacted . . . or by affixing an adhesive tape on the surface of the closely contacted green veneer strips." See U.S. Pat. No. 4,044,182 at column 1, lines 30-34.

The inventors of the present disclosure recognized, however, that the use of tape to unify core pieces is problematic in modern plywood manufacturing processes, which are designed for high-speed production. In most modern plywood manufacturing process, the core pieces are lined up by hand or by machine in a continuous stream. Due to a variety of factors, including human error, gaps can be created between the core pieces. These gaps can interfere with devices designed to apply tape continuously. For example, when a gap is encountered, a tape applicator designed to apply tape continuously might be damaged by contacting the underlying conveyor, particularly if the conveyor is a metal chain.

The inventors also recognized that applying tape to a continuously moving line of core pieces can cause the core pieces to overlap or become skewed. This typically occurs when the tape applicator interferes with the movement of the core pieces. Tape applicators apply at least some force to the core pieces, such as by rolling along the surface of the core pieces. When the force resisting movement of the core pieces is greater than the friction between the core pieces and the conveyor, the core pieces can be shifted out of alignment. Core pieces often are very thin, with a typical thickness being about one tenth of an inch, so they overlap easily. When one core piece is slowed or stopped by the tape applicator, the line will continue to move and the core pieces will begin to overlap. When the core pieces overlap, the process typically must be halted while the core pieces are realigned, resulting in lost production time and/or loss of product.

The inventors of the present disclosure recognized a need for tape application devices and methods that are compatible with continuous manufacturing processes. For example, the inventors recognized a need for tape application devices and methods capable of intermittent application of tape to continuously moving sheets of material. Such devices and methods were recognized as useful for a broad range of applications, including the effective processing of gaps between sheets of material to be joined.

SUMMARY

Disclosed herein are a device and a method that overcome some of the challenges associated with tape application in automated processes. The device can be configured to apply tape to a material surface of one or more sheets of material moving in a flow direction, such as plywood core pieces moving along a conveyor. Typically, the device remains substantially stationary and applies tape to the material surface along a direction generally parallel to the flow direction. The tape can be applied by a tape applicator, such as a tape applicator that comprises a wheel configured to roll along the material surface. In some disclosed embodiments, the tape applicator wheel is heated to heat activate the tape. In other embodiments, the tape applicator wheel is unheated.

Some disclosed embodiments are configured for intermittent tape application and comprise a controller for controlling the device during automatic operation. Tape application can be terminated by signaling a first lift to move the tape applicator away from the material surface. If the tape applicator has applied a first portion of tape to the material surface, moving the tape applicator away from the material surface creates an unattached tape portion between the tape applicator and a final connection point on the material surface. The unattached tape portion then can be cut at a cutting point by a tape cutter. The tape cutter typically comprises a cutting blade, such as a serrated cutting blade. After the unattached tape portion is cut, a remaining unattached tape portion is left attached to the tape applicator.

Restarting the tape application can begin by signaling the first lift to move the tape applicator toward the material surface. To ensure that the remaining unattached tape portion is bonded to the material surface and to prevent the remaining unattached tape portion from curling around the tape applicator, some disclosed embodiments comprise an engagement-initiation press positioned along the flow direction between the tape applicator and the tape cutter. A second lift can be used to move the engagement-initiation press toward the material surface such that, as tape application is restarted, the engagement-initiation press engages the material surface at about the same time or before the tape applicator engages the material surface. The second lift then can be signaled to raise the engagement-initiation press at about the same time or after the tape applicator engages the material surface.

Some disclosed embodiments comprise a tape gripper to grip the unattached tape portion at a gripping site between the cutting point and the tape applicator. The tape gripper can be positioned between the tape applicator and the tape cutter and can be combined with or separate from the tape cutter. In some disclosed embodiments, the tape gripper comprises a first block and a second block. The first block, the second block or both can be movably mounted to provide a gripping action. When the tape applicator moves away from the material surface, it can cause the unattached tape portion to contact the tape gripper or position itself between the first block and the second block. At this point, the tape gripper can be signaled to grip the unattached tape portion. The tape gripper typically is signaled to grip the unattached tape portion after the tape cutter is signaled to cut the unattached tape portion. The tape gripper then can be signaled to release the unattached tape portion during the restarting sequence at about the same time or after the engagement-initiation press engages the material surface One example of a combined tape cutter and tape gripper comprises a cutting blade, a fixed block and a movable block. The movable block is connected to a linear actuator by a resilient member and the cutting blade is connected to the linear actuator by a substantially fixed member. When the linear actuator moves the movable block and the cutting blade in an actuating direction, an engagement side of the movable block presses the unattached tape portion against the fixed block while a cutting edge of the cutting blade extends across the unattached tape portion. Due to the action of the resilient member, the cutting edge of the cutting blade goes from being recessed relative to the engagement side of the movable block to protruding relative to the engagement side of the movable block as the linear actuator moves in the actuating direction.

Some of disclosed embodiments configured for intermittent operation are further configured for processing gaps between two or more sheets of material. These disclosed embodiments can detect gaps, for example, with a sensor. When the sensor detects a beginning of a gap, it can send a signal to the controller to begin a gap processing sequence. The gap processing sequence can begin, for example, with the controller signaling the first lift to move the tape applicator away from the material surface. Similarly, when the sensor detects an ending of the gap, it can send a signal to the controller to end the gap processing sequence. Ending the gap processing sequence can include the controller signaling the first lift to move the tape applicator toward the material surface.

In some applications, sheets of material can be pushed out of alignment by the drag forces associated with tape application. In response to this problem, some disclosed embodiments of the tape application device comprise a hold-down portion to inhibit movement of the sheets of material in at least one direction other than the flow direction during application of tape to the material surface. The hold down portion can comprise one or more pressing portions. For example, some disclosed embodiments comprise a first pressing portion and a second pressing portion, with the first and second pressing portions positioned on opposite sides of the tape applicator along a line generally perpendicular to the flow direction. In some disclosed embodiments, at least one of the pressing portions defines a flat bottom surface configured to be placed in slidable engagement with the material surface or a belt configured to be placed in rotatable engagement with the material surface. Pressing portions configured to be placed in slidable engagement with the material surface can be inclined relative to the material surface, so as to apply increasing pressure to the material surface as the sheets of material move in the flow direction. The pressing portions also can comprise one or more projections inclined relative to the material surface. When positioned adjacent to the material surface, these projections tend to inhibit movement of the sheets of material in at least one direction other than the flow direction.

A method for intermittently applying tape to one or more continuously conveyed sheets of material moving in a flow direction also is disclosed. Intermittent application can include any combination of the steps of applying, lifting, gripping, cutting and/or reapplying the tape. Some disclosed embodiments of the method comprise applying tape to the surface of the one or more sheets of material along a line generally parallel to the flow direction with a tape applicator. The tape applicator can be moved away from the material surface so as to create an unattached tape portion extending between the tape applicator and a final connection point on the material surface. The unattached tape portion then can be cut at a cutting point with a tape cutter. Some embodiments further comprise gripping the unattached tape portion at a gripping site between the cutting point and the tape applicator. To restart tape application, the tape applicator can be moved toward the material surface. Restarting tape application also can include moving an engagement-initiation press toward the unattached tape portion so as to attach a first point of the unattached tape portion to the material surface. This can be done, for example, before the tape applicator engages the material surface.

Some embodiments of the disclosed method are specially configured for joining sheets of material. For example, some embodiments comprise moving a plurality of separate sheets of material along a flow direction to form a line-up with a material surface and intermittently applying tape to the material surface. The line-up can comprise two or more contiguous portions separated by gaps, with each contiguous portion comprising at least two sheets of material substantially abutting one another edge-to-edge. In some disclosed embodiments, the tape is applied to connect the sheets of material in at least one of the contiguous portions. When a gap is encountered, the tape is cut. Similarly, some disclosed embodiments of the method comprise dispensing tape from the tape applicator during an application period and ceasing to dispense tape from the tape applicator during a cessation period. The application period can occur, at least in part, while the tape applicator is positioned above a contiguous portion and the cessation period can occur, at least in part, while the tape applicator is positioned above a gap.

Some disclosed embodiments of the method comprise connecting the tape to a first surface of a first contiguous portion with a tape applicator, sensing a beginning of a first gap and then moving the tape applicator away from the first surface. This causes an unattached tape portion to extend between the tape applicator and a final connection point on the first surface. The unattached tape portion then is cut at a cutting point. Disclosed embodiments of the method also can comprise gripping the unattached tape portion at a gripping site between the cutting point and the tape applicator and releasing the unattached tape portion at the gripping site after cutting the unattached tape portion at the cutting point.

Some disclosed embodiments also comprise sensing an ending of the first gap and moving an engagement-initiation press toward the unattached tape portion so as to attach a first point of the unattached tape portion to a second surface of a second contiguous portion. The tape applicator then is moved into engagement with the second surface at about the same time or after the engagement-initiation press engages the second surface. The engagement-initiation press typically is moved away from the second surface at about the same time or after moving the tape applicator into engagement with the second surface.

In some disclosed embodiments, the sheets of material are held down to prevent them from shifting out of alignment. The sheets of material can be held down, for example, in an application area around an application point at which the tape applicator engages the material surface. In some disclosed embodiments, the sheets of material are held down by a hold-down portion, as described above.

DETAILED DISCUSSION

Figure 1:
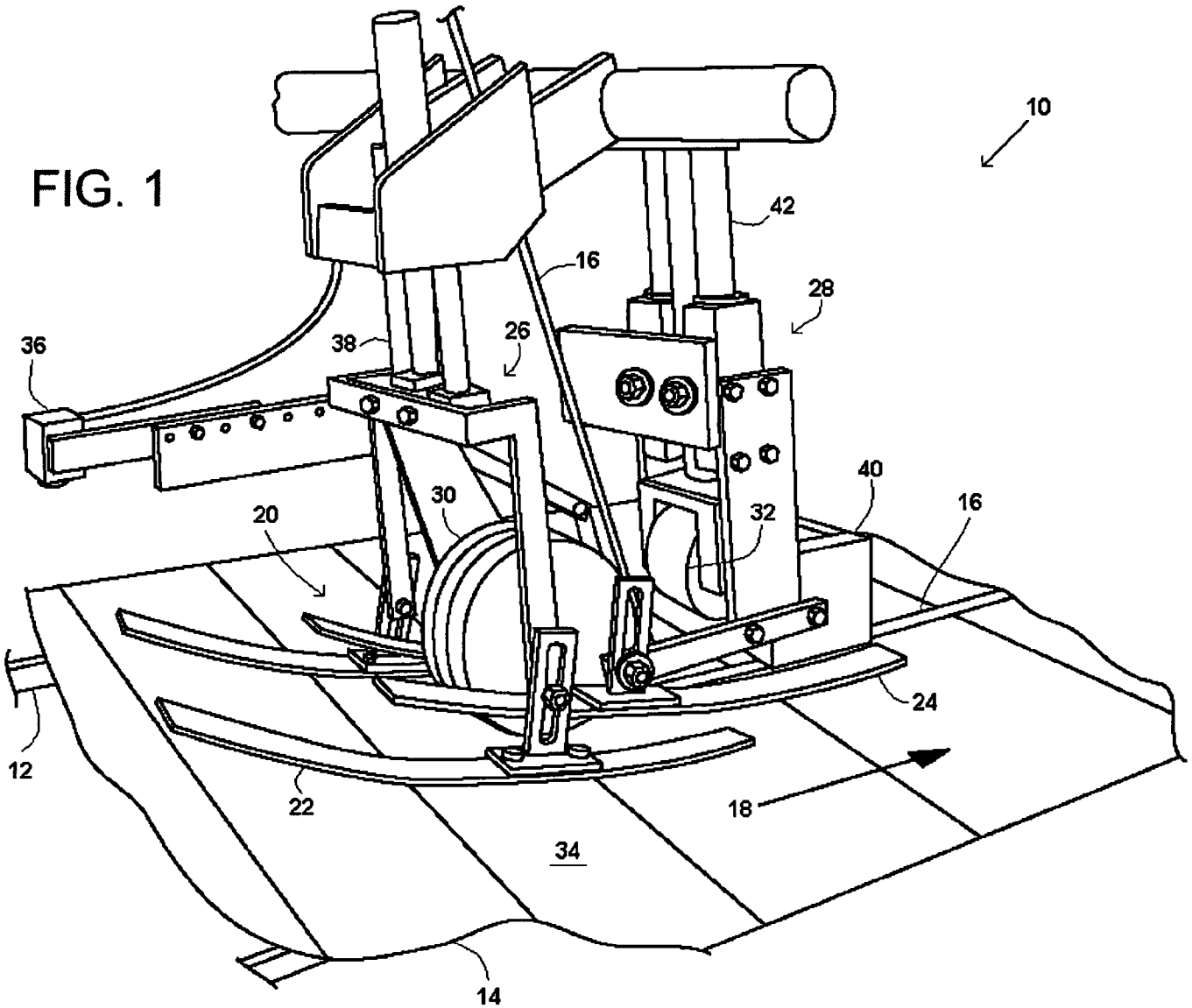
FIG. 1 is a perspective view of an embodiment of the disclosed tape application device installed on a plywood assembly line.
Figure 2:
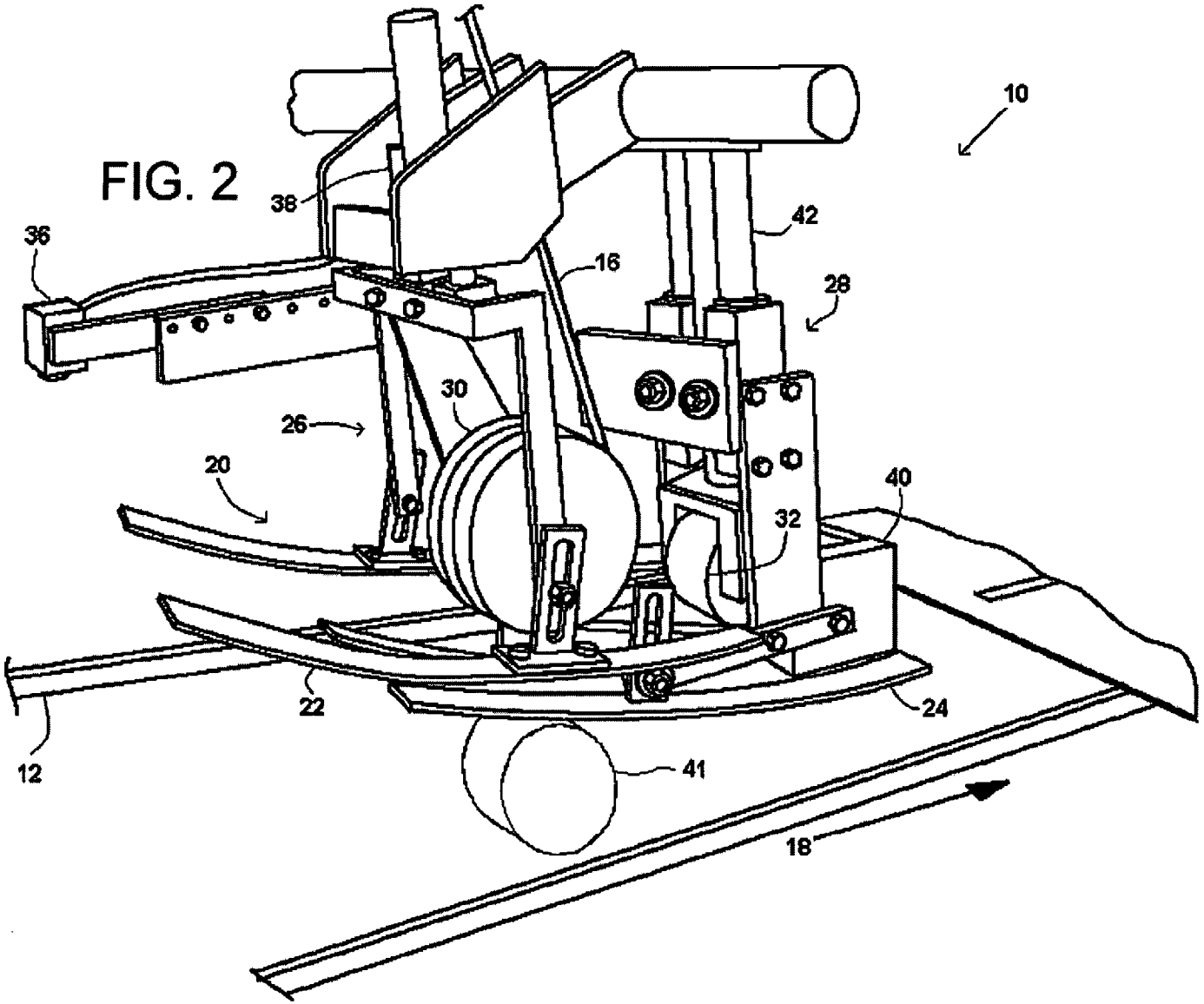
FIG. 2 is a perspective view showing the tape application device illustrated in FIG. 1 with the tape applicator wheel lifted away from the material surface in response to a signal.
Figure 3:
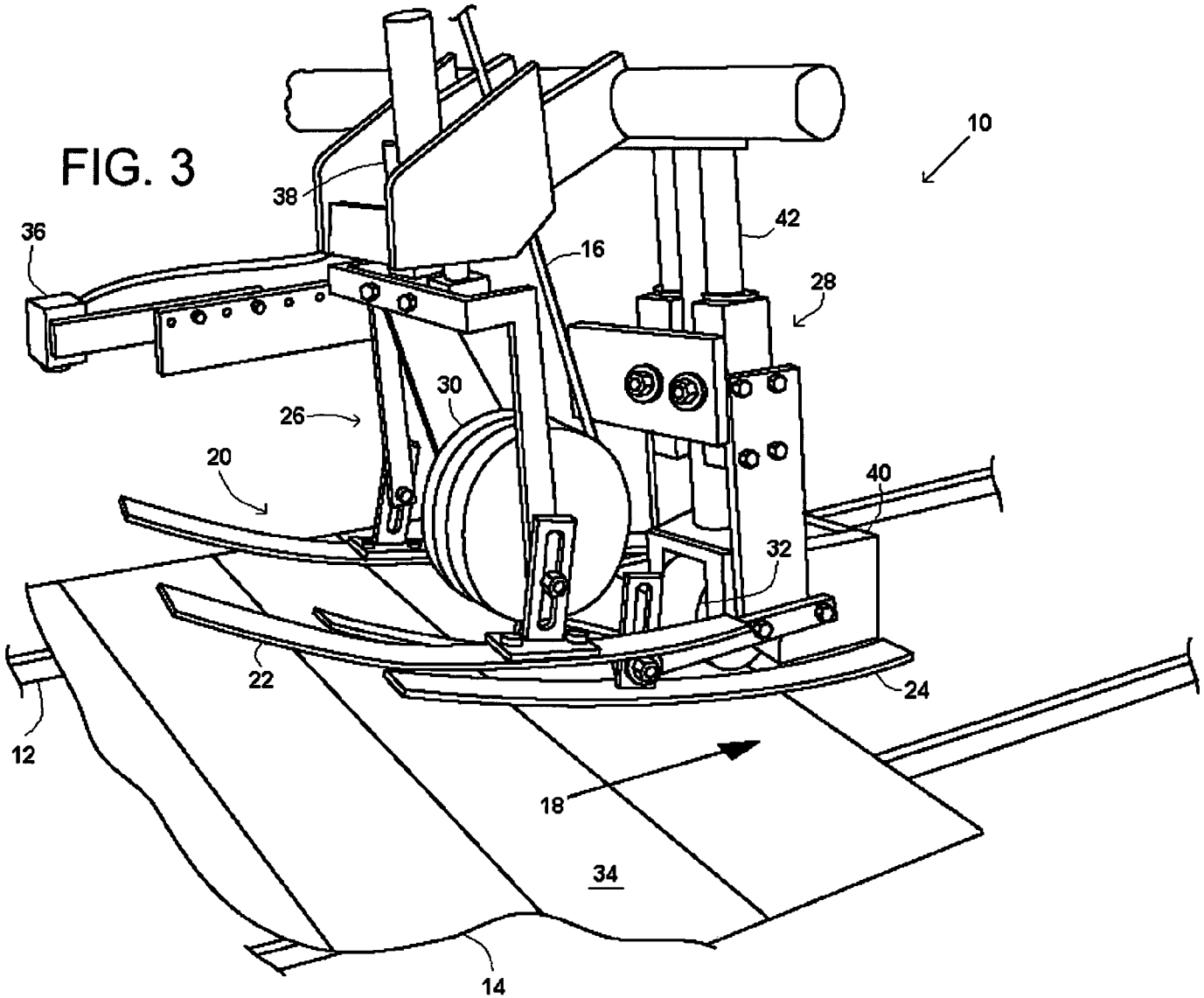
FIG. 3 is a perspective view showing the tape application device illustrated in FIG. 1 with the engagement-initiation press lowered to restart the tape application process in response to a signal.

By way of introduction, FIGS. 1-3 illustrate one embodiment of the disclosed tape application device. The reference numbers in FIGS. 1-3 are consistent. FIG. 1 shows the tape application device during normal operation. Tape application device 10 is installed over a conveyor 12 and configured to unify sheets of material 14 with tape 16. The sheets of material 14 are transported by the conveyor 12 in a flow direction 18. The tape application device 10 is configured to hold down the sheets of material 14 with a hold-down portion 20. The hold-down portion 20 comprises a first set of skis 22 and a second set of skis 24. The first set of skis 22 is connected to a tape applicator 26. The second set of skis is connected to an engagement-initiation press 28. The tape applicator 26 comprises a tape applicator wheel 30, which may be heated or unheated. The engagement-initiation press 28 comprises an engagement-initiation press wheel 32. When applying tape, the tape applicator wheel 30, the first set of skis 22 and the second set of skis 24 all engage a material surface 34 of the sheets of material 14. In contrast, the engagement-initiation press wheel 32 is raised above the material surface 34.

The tape 16 extends from a tape supply (not shown) around a pulley (not shown) and over the tape applicator wheel 30. The pulley is useful for increasing contact between the tape applicator wheel 30 and the tape 16. In embodiments in which the tape applicator wheel 30 is heated and the tape 16 is heat-activated tape, the increased contact between the tape applicator wheel 30 and the tape 16 helps to ensure that the tape 16 is sufficiently heated. During operation, the tape applicator wheel 30 rolls along the material surface 34. As the tape applicator wheel 30 rolls, it dispenses the tape 16 and attaches it to the material surface 34. The engagement-initiation press wheel 32 is aligned relative to the position of the tape applicator wheel 30, such that the tape 16 passes directly below the engagement-initiation press wheel 32.

A sensor 36 is positioned to detect the presence of features, such as gaps between the sheets of material 14, before these features reach the tape applicator 26. For example, when the sensor 36 detects a triggering feature, such as a gap between the sheets of material 14, a controller (not shown) signals a first lift 38 to raise the tape applicator wheel 30 along with the first set of skis 22. The tape 16 then is cut and held in place by a combined tape cutter and tape gripper (not shown) located adjacent to a safety guard 40 downstream from the engagement-initiation press 28 in the flow direction 18. FIG. 2 shows the embodiment illustrated in FIG. 1 with the tape applicator wheel 30 and the first set of skis 22 raised from the material surface 34 in response to a gap. In FIG. 2, a support wheel 41 is visible below the tape applicator wheel 30. The support wheel 41 lines up with the tape applicator wheel 30, such that during tape application the sheets of material 14 are held between the tape applicator wheel 30 and the support wheel 41. A support wheel may be included in any of the embodiments disclosed herein.

When the sensor 36 detects another triggering feature, such as an end of a gap, the controller signals a second lift 42 to lower the engagement-initiation press wheel 32. The controller also signals the combined tape cutter and tape gripper to release the tape 16. Once it is lowered, the engagement-initiation press wheel 32 presses the tape 16 onto the material surface 34. This prevents the tape 16 from curling around the tape applicator wheel 30. FIG. 3 shows the embodiment illustrated in FIG. 1 with the engagement-initiation press wheel 32 in engagement with the material surface 34.

Once the engagement-initiation press wheel 32 has reinitiated contact between the tape 16 and the material surface 34, the first lift 38 is signaled to lower the tape applicator wheel 30 and the second lift 42 is signaled to raise the engagement-initiation press wheel 32. The tape application device 10 then is reset in the configuration illustrated in FIG. 1.

Figure 4:
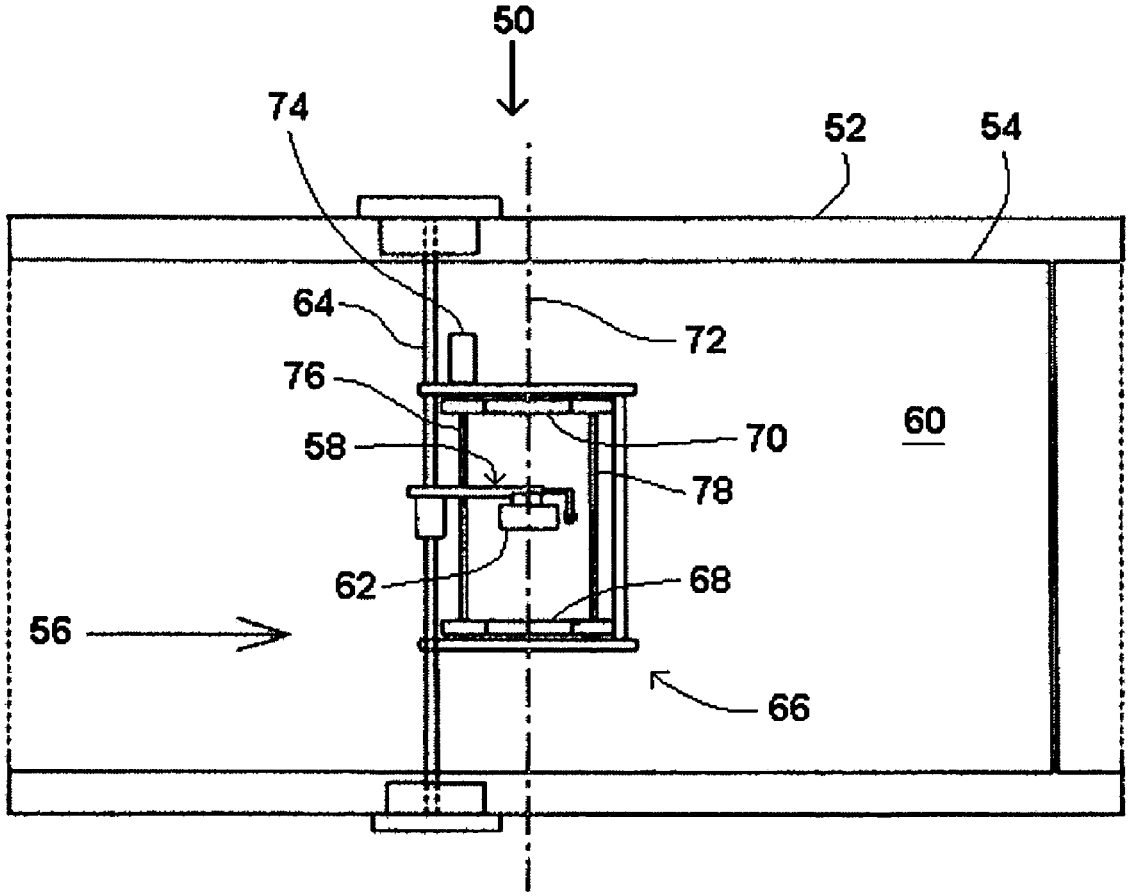
FIG. 4 is a plan view of an embodiment of the disclosed tape application device installed on a plywood assembly line.

FIG. 4 is a plan view of another embodiment of the disclosed tape application device. The illustrated tape application device 50 is installed over a conveyor 52 and configured to unify sheets of material 54. The sheets of material 54 are transported by the conveyor 52 in a flow direction 56. The tape application device 50 comprises a tape applicator 58. The tape applicator 58 applies tape to a material surface 60 of the sheets of material 54 with a tape applicator wheel 62. The tape applicator wheel 62 rolls along the material surface 60 as the sheets of material 54 move in the flow direction 56. The tape application device 50 can be moved along a cross bar 64 to apply tape to different portions of the material surface 60. The tape application device 50 also can be lifted away from the material surface 60 to allow easy access to the sheets of material 54.

The tape application device 50 is configured to hold down the sheets of material 54 with a hold-down portion 66. The hold-down portion 66 comprises a first belt 68 and a second belt 70 positioned symmetrically on either side of the tape applicator 58 along a line 72 perpendicular to the flow direction 56. The belts 68 and 70 have elongated lengths and are oriented with their lengths parallel to the flow direction 56. Like the tape applicator wheel 62, the belts 68 and 70 are configured to roll along the material surface 60 as the sheets of material 54 move in the flow direction 56. As they roll, the belts 68 and 70 apply downward pressure to hold the sheets of material 54 in place. The belts 68 and 70 are driven by a motor 74, which rotates a first axle 76. The first axle 76 and a second axle 78 extend between the belts 68 and 70 and coordinate their motion. The rotation of the belts 68 and 70 is synchronized with the speed at which the sheets of material 54 are moving in the flow direction 56.

The tape application device 50 does not include many of the elements included in the tape application device shown in FIGS. 1-3. As shown, the tape application device 50 is not configured for intermittent tape application. Additional elements can be added, however, to provide this functionality. For example, the tape application device 50 can be modified to include a sensor, a tape cutter, a tape gripper, and an engagement-initiation press, such as those included in the tape application device illustrated in FIGS. 1-3.

Figure 5:
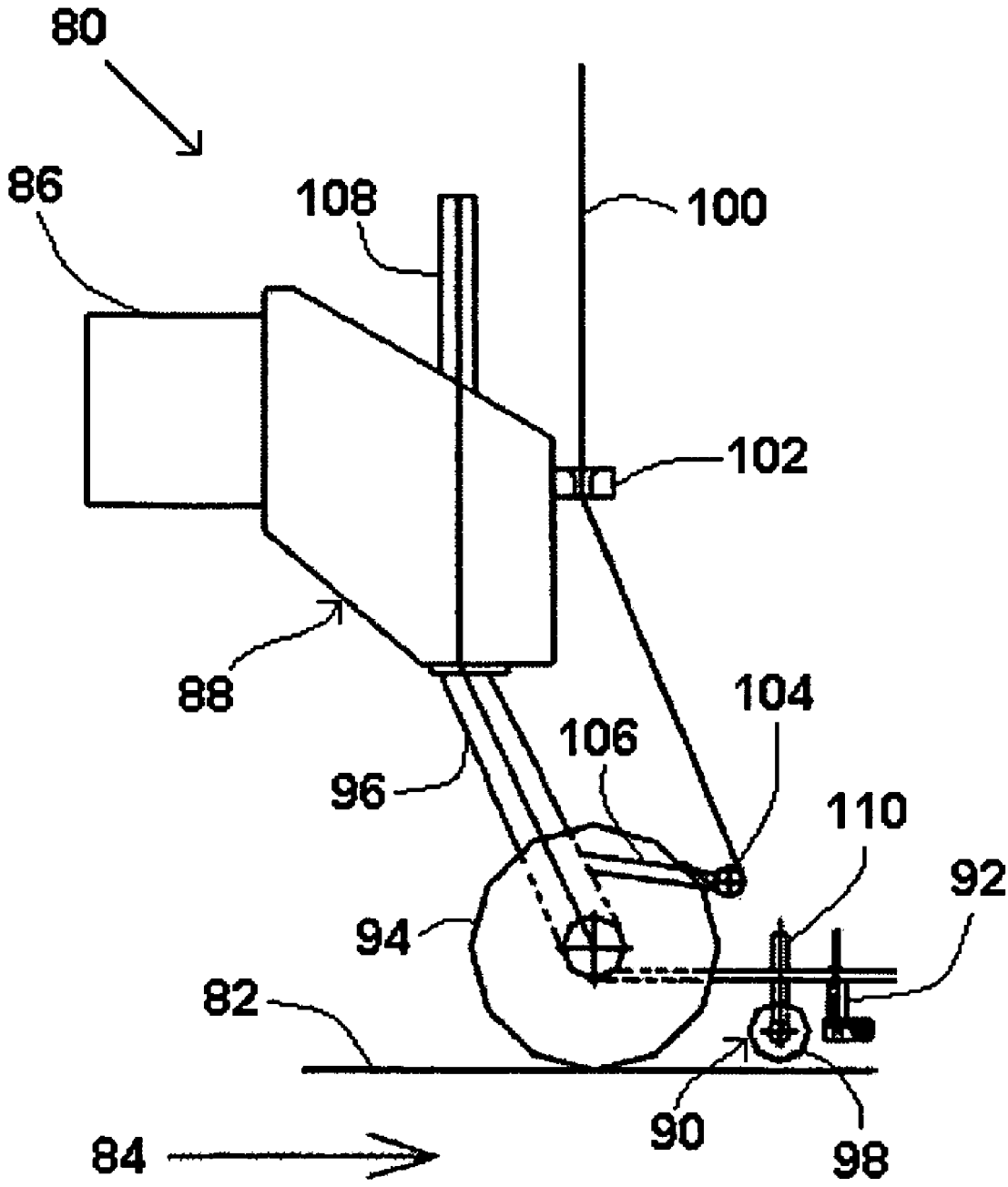
FIG. 5 is a side elevation view of an embodiment of the disclosed tape application device.

FIG. 5 illustrates an embodiment of the disclosed tape application device configured for intermittent tape application. The illustrated tape application device 80 is installed over a material surface 82 of sheets of material moving in a flow direction 84. The tape application device 80 comprises a sensor 86, a tape applicator 88, an engagement-initiation press 90 and a combined tape cutter and tape gripper 92. The tape applicator 88 comprises a tape applicator wheel 94 rotatably mounted on a support arm 96. The engagement-initiation press 90 comprises an engagement-initiation press wheel 98. Tape 100 extends from a tape supply (not shown) around the tape applicator wheel 94. Before it reaches the tape applicator wheel 94, the tape 100 extends through a guide 102 and around a pulley 104. The pulley 104 is attached to the support arm 96 by a pulley support 106. The tape applicator 88 and the engagement-initiation press 90 can be raised and lowered relative to the material surface 82 by a first lift 108 and a second lift 110, respectively.

The various elements of the embodiments illustrated in FIGS. 1-5 can be interchanged to provide additional embodiments with different functional characteristics. For example, the skis illustrated in FIGS. 1-3 can be replaced with belts, as shown in FIG. 4. Another exemplary embodiment can be formed by combining the tape application device shown in FIG. 5 with the hold-down portion shown in FIG. 4.

The embodiments illustrated in FIGS. 1-5 are merely exemplary. This disclosure also describes additional embodiments not limited to the particular features illustrated in FIGS. 1-5. All of the disclosed embodiments have one or more features not found in the prior art. Some of these features are discussed in the following subsections.

Tape Applicator and Tape

Disclosed embodiments of the tape application device comprise a tape applicator. In some disclosed embodiments, the tape applicator is the component configured to apply tape to the material surface. The tape applicator, for example, can be configured to apply tape to the material surface as the sheets of material move in the flow direction. The tape can be applied along a line generally parallel to the flow direction. In some disclosed embodiments, the tape applicator comprises a tape applicator wheel configured to rotate along the material surface and dispense tape as it rotates. As the tape applicator wheel presses the tape onto the material surface, it simultaneously places tension on the tape. Since one end of the tape is bonded to the material surface and held down by the tape applicator wheel, the tension can cause additional tape to be drawn from a tape supply, such as a spool.

As the tape applicator wheel rolls along the material surface, the sheets of material typically are supported in some manner. Suitable forms of support include belts, chains, wheels and plates. This support can, for example, be positioned on the side of the sheets of material opposite to the side engaged by the tape applicator, such that the sheets of material are held between a portion of the tape applicator and the support as tape is applied. In some embodiments, the support also serves as a conveyor.

Some examples of suitable tape applicators for incorporation into the disclosed tape application device are described in U.S. Pat. Nos. 6,358,356 and 6,368,449. In some disclosed embodiments, the tape applicator wheel comprises a heater for heat-activating the tape. The heater can be positioned, for example, to provide evenly-distributed heat to the surface of the tape applicator wheel. In other embodiments, the tape applicator wheel is unheated. Unheated tape applicator wheels can be used, for example, to apply pressure-sensitive tape. To apply water-activated tape, the tape applicator can include a wetting system, such as a sprayer. The surface of the tape applicator wheel can be configured to resist bonding. For example, the surface of the tape applicator wheel can comprise a smooth, non-porous material with a low affinity for the adhesives in the tape.

The disclosed tape application device can be used with a variety of tapes. The term "tape" is a generic term referring to a flexible elongate reinforcing member. The term includes, but is not limited to, materials with flat surfaces and materials with rounded surfaces, such as strings and cords. The tape can have a variety of widths, including but not limited to, widths between about 1.22 millimeters and about 29 millimeters, such as widths between about 2 millimeters and about 20 millimeters. Some types of tape comprise structural components such as strips, strands or filaments of various materials, including polymers, such as polyester. As mentioned above, some disclosed embodiments are configured to apply heat-activated tape. This type of tape can comprise, for example, one or more strings surrounded by a hot-melt adhesive.

The tapes well-suited for use with the disclosed tape application device typically comprise an adhesive, such as a hot-melt adhesive, a pressure-sensitive adhesive, a water-activated adhesive, a remoistenable adhesive, a water-dispersible adhesive, a biodegradable adhesive, a repulpable adhesive or an adhesive characterized by two or more of these properties. Some examples of hot-melt adhesives are ethylene-vinyl acetate copolymer hot-melt adhesives, ethylene methylacrylate hot-melt adhesives, ethylene n-butyl acrylate hot-melt adhesives, hot-melt adhesives comprising polyamides, remoistenable hot-melt adhesives comprising polyamides and copolyesters, radio frequency activatable hot-melt adhesives, rubbery block copolymer hot-melt adhesives, and hot-melt adhesives comprising polyethylene and polypropylene homopolymers, copolymers or interpolymers.

Some types of tape for use with the disclosed tape application device comprise a backing on at least one major surface. The backing can be integral or removable. One example of a backing is a paper backing, such as a kraft paper backing. For many applications, it is advantageous to apply tape with a backing and leave the backing in place. Leaving the backing in place is helpful, for example, in plywood manufacturing processes in which the plywood product is heated and pressed before it is fully assembled. This type of process often is used to manufacture plywood products that comprise large numbers of plies, such as laminated veneer lumber products. Unlike the stationary hot presses that are used on fully assembled plywood panels, moving hot-press conveyor systems typically are used to apply heat and pressure to plywood products before they are fully assembled. It is advantageous to apply tape with a backing because the backing helps to prevent hot-melt adhesive from accumulating on the surfaces of the moving hot-press conveyors.

Some embodiments of the tape-application device similar to the embodiment illustrated in FIG. 5 can be used to apply tape comprising a backing. Certain types of tape, however, are difficult to activate without directly contacting the adhesive side of the tape with a heated surface. To apply this type of tape, it is helpful to configure the tape application device so that the adhesive side of the tape contacts the tape applicator wheel, which can be heated.

Figure 6:
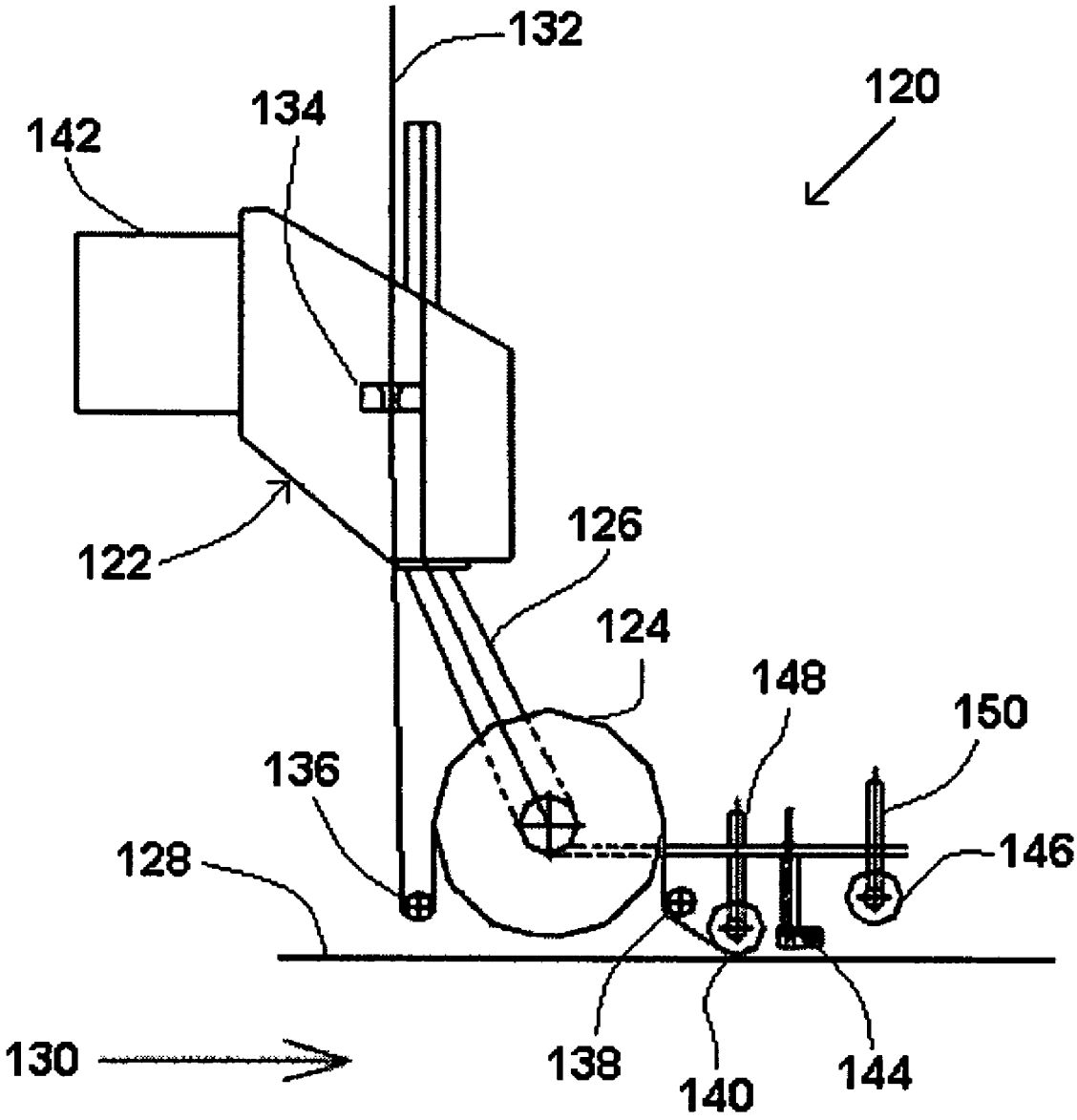
FIG. 6 is a side elevation view of an embodiment of the disclosed tape application device.

The tape application device 120 illustrated in FIG. 6 is well-suited for applying tape comprising a backing, such as heat-activated tape comprising a backing. Many of the elements of the embodiment illustrated in FIG. 6 are similar to the elements of the embodiment illustrated in FIG. 5. A tape applicator 122 comprising a tape applicator wheel 124 is suspended on a support arm 126 above a material surface 128 of sheets of material moving in a flow direction 130. Tape 132 extends from a tape supply (not shown) through a guide 134. The tape 132 is held against a portion of the tape applicator wheel 124 by a first pulley 136 and a second pulley 138. The first pulley 136 and the second pulley 138 are attached to the support arm 126 by pulley supports (not shown). The first pulley 136 and the second pulley 138 increase the contact between the tape 132 and the tape applicator wheel 124. This can be helpful, for example, to ensure that the tape 132 is sufficiently heated. After contacting the second pulley 138, the tape 132 is pressed against the material surface 128 by a first pressing wheel 140. For intermittent operation, the illustrated tape application device 120 also comprises a sensor 142, a combined tape cutter and tape gripper 144 and a second pressing wheel 146. The first pressing wheel 140 and the second pressing wheel 146 can be moved toward and away from the material surface 128 by a first pressing wheel lift 148 and a second pressing wheel lift 150, respectively.

The configuration illustrated in FIG. 6 enables the same side of the tape, e.g. the adhesive side, to be directly heated and then pressed onto the material surface. In addition to preventing the build up of adhesive on the moving hot-press conveyor systems, the presence of a backing also helps to prevent the tape from sticking to the first and second pressing wheels, which typically are unheated. The backing also strengthens the tape. Strong tape is useful because, in some disclosed embodiments, the tape drives the rotation of the tape-applicator wheel.

Some disclosed embodiments of the tape application device are designed to separate the backing from the adhesive portion before or after applying the adhesive portion to the material surface. For example, in a disclosed embodiment similar to the embodiment illustrated in FIG. 5, the backing is routed around the engagement-initiation press to a receiving spool rotating at a speed sufficient to take up the backing. For intermittent tape application, the receiving spool is signaled to stop rotating when the tape applicator wheel stops rotating. Separating the backing from the adhesive portion at a point on the tape upstream from the point that engages the tape cutter allows the backing to be removed in one continuous piece.

Intermittent Application

Some disclosed embodiments of the tape application device are capable of rapidly beginning and ending the application of tape to a material surface of one or more sheets of material. Throughout this disclosure, the term "sheets of material" can refer to sheets of any size and shape, including continuous sheets, such as webs. Similarly, the material can be any material, such as wood, metal, plastic, cardboard or paper. In the context of plywood manufacturing, the term "sheets of material" encompasses strips, core pieces, standard size veneer pieces, plies, and sheets of any other size and shape.

Embodiments capable of intermittent operation typically are capable of applying separate strips of tape to sheets of material without significantly disrupting the movement of the sheets of material along a flow direction. These embodiments therefore are compatible with continuous manufacturing processes that require the selective application of tape and/or the selective non-application of tape at any point or location along the material surface. For example, some embodiments can be used to join sheets of material with separate pieces of tape extending across joints between the sheets of material. These embodiments also can be used to apply pieces of tape that begin and end on the same sheet of material, which can be useful, for example, to mask certain parts of the sheets of material while leaving other parts exposed. Typically, embodiments capable of intermittent operation also are capable of continuous operation. For example, some embodiments have settings for both intermittent and continuous operation. Continuous operation typically entails the application of an unbroken length of tape to sheets of material without beginning or ending tape application while the sheets of material are moving past the tape application device in the flow direction.

In some embodiments, the tape can be applied at predetermined intervals. For example, the tape spacing can be controlled by predetermined time intervals (e.g., tape can be applied for 5 seconds, not applied for 5 seconds and then reapplied for five seconds) or by predetermined length intervals along the flow direction. In some embodiments, the leading edge of a sheet of material can be sensed to determine where to apply each interval of tape.

Intermittent tape application is especially useful for processing gaps. In contrast to a joint, which exists between sheets of material that substantially abut one another, gaps are present between sheets of material that are spaced apart. As mentioned above, in many continuous manufacturing processes, gaps occasionally are created between the sheets of material. The size of any one gap is determined by the distance between the sheets of material on either side of the gap. Gaps can have a variety of sizes, such as sizes greater than about 1 centimeter, sizes greater than about 5 centimeters or sizes greater than about 20 centimeters. The term "gap" includes small gaps and large gaps. Large gaps can be created, for example, in plywood manufacturing processes when one or more sheets of material are missing from a lineup. A threshold distance specific to the application defines the difference between a joint and a gap. For example, in some plywood manufacturing processes, the sheets of material rarely touch each other edge-to-edge, so small separations are not considered to be gaps. The threshold size for these applications typically is greater than the threshold size for applications in which spacing between the sheets of material is less common.

Typically, the tape applied to unify sheets of material is continuous and must be severed each time a gap is encountered. Once the tape has been severed, it can be difficult to restart the tape application without disrupting the continuity of the manufacturing process. Prior art tape application devices are not well suited for dealing with gaps. In contrast, some disclosed embodiments of the tape application device are configured to efficiently process gaps.

Controller and Sensor

Embodiments of the tape application device that are configured for intermittent tape application typically begin and end tape application in response to control signals sent by a controller, such as a programmable logic controller (PLC). The controller can be any device capable of sending control signals to coordinate the automatic operation of the tape application device. The controller can be a single device or a combination of two or more devices. One example of a suitable PLC is the Micrologix 1500 manufactured by Rockwell Automation (Milwaukee, Wis.), which can be programmed with the language RSLogix 500. The controller receives inputs, such as push buttons, switches, sensors and line status. These inputs are then processed to activate appropriate outputs according to the programming logic.

If control signals to begin and end tape application are sent at regular intervals, the tape application device typically applies uniformly sized pieces of tape to the sheets of material with uniform spacing. This can be useful for highly controlled processes. Most processes, however, have enough variation to make them incompatible with the application of tape at fixed intervals of time or distance. In these processes, the control signals that begin and end tape application can be triggered by human intervention or by automatic sensors. Sensors can be used to detect process events or features of the material and trigger tape application to begin or end in response to these events or features. For example, in gap processing, the sensors can be gap-detecting devices configured to detect the beginning and ending of gaps.

Some examples of sensors suitable for use with embodiments of the disclosed tape application device include, but are not limited to, mechanical devices, electrical devices and optical devices. A mechanical sensor, for example, can comprise a wheel that rolls along the material surface and measures distance or resistance to downward pressure. An electrical sensor, for example, can operate by squeezing the sheets of material between two rolling electrodes and sensing the electrical resistance between the electrodes. Other useful sensors include pneumatic sensors, infrared sensors and sensors that comprise cameras.

Optical sensors, such as photoelectric laser sensors, are particularly well-suited for use with the disclosed tape application device. Optical sensors can be used, for example, to detect irregularities in a material surface or gaps between sheets of material. Some useful types of photoelectric laser sensors are through-beam laser sensors, retroreflective laser sensors, and proximity laser sensors. Through-beam laser sensors send a beam from an emitter to a detector and send a signal when an object blocks the path of the beam or when an object ceases to block the path of the beam. Retroreflective laser sensors operate on the same principle, except that the beam generated by the emitter is bounced off a reflector and received by a detector contained with the emitter in a single unit. Proximity laser sensors can detect the presence of an object or measure the distance to an object by bouncing a beam off the object and measuring the properties of the reflected beam or the amount of time it takes for the reflected beam to reach the detector.

Some disclosed embodiments comprise a laser sensor positioned so that the sheets of material encounter a beam generated by the laser sensor before they encounter the tape applicator. Thus, tape application can be started or stopped before the detected feature, such as a gap, reaches the tape applicator. In embodiments configured to detect gaps, the sensor can comprise an emitter and a detector positioned on the same side of the sheets of material or on opposite sides of the sheets of material. A beam traveling from the emitter to the detector generally is blocked by the sheets of material and becomes unblocked when it encounters a gap between the sheets of material. When the detector senses the beam, it sends a signal indicating the beginning of a gap. When the detector no longer senses the beam, it sends a signal indicating the ending of the gap. The size of the gap can be determined, for example, by measuring the length of time that the beam shines on the detector without interruption and multiplying this number by the rate at which the sheets of material are traveling. In some disclosed embodiments, the gap processing steps will only be initiated if the gap is greater than a threshold size. The threshold size can be, for example, greater than about 1 centimeter, greater than about 2 centimeters, or greater than about 3 centimeters.

The Unattached Tape Portion

Once a triggering feature, such as a gap greater than the threshold size, has been detected, the tape application device can be signaled to begin or end tape application, as appropriate. In some disclosed embodiments, termination of tape application begins by moving the tape applicator away from the material surface. If a gap is present, moving the tape applicator away from the material surface prevents the tape applicator from slipping into the gap, which could block the path of the sheets of material and prevents the tape applicator from engaging the conveyor, which could damage the tape applicator.

The tape applicator can be moved, for example, by the action of a first lift. The first lift can be any device capable of moving the tape applicator, including, but not limited to, solenoids, hydraulic devices, pneumatic devices, linear actuators and pistons. In some disclosed embodiments, the first lift is a combination of two or more devices with one designated for moving the tape applicator toward the material surface and one designated for moving the tape applicator away from the material surface.

As the tape applicator is moved away from the material surface by the action of the first lift, the tape remains attached. An unattached tape portion is created between the tape applicator and a final connection point on the material surface. Since the sheets of material still are moving in the flow direction, the unattached tape portion can extend in any direction between the tape applicator and the final connection point.

Tape Cutter

Disclosed embodiments of the tape application device configured for intermittent tape application comprise a tape cutter configured to cut the unattached tape portion. The tape cutter can be any component capable of cutting the unattached tape portion. Some suitable tape cutters comprise a cutting blade, such as a cutting blade that is at least partially serrated. It has been discovered that, in general, tape can be cut more easily with a serrated cutting blade than with a flat edge cutting blade. Tension on the tape also facilitates cutting. Tape held at higher tension generally is easier to cut than tape held at lower tension. In some disclosed embodiments, the cutting blade is mounted on one end so that it can swing across the tape. Alternatively, the cutting blade can be configured to move in a straight line or rotate. The cutting blade can be actuated, for example, with a solenoid, a hydraulic device, a pneumatic device, a linear actuator or a piston. In some disclosed embodiments, the cutting blade engages the tape at high speed, such as a speed greater than 2 meters per second, typically greater than 5 meters per second, and even more typically greater than 10 meters per second. The cutting blade also can be heated to improve its ability to cut heat-sensitive tape. As an alternative to a cutting blade, some disclosed embodiments include a water jet or a laser.

The tape cutter typically is positioned downstream from the tape applicator along the flow direction. In some disclosed embodiments, the tape cutter is positioned to be adjacent to the unattached tape portion. For example, when the tape applicator moves away from the material surface, the unattached tape portion can extend into the path of the cutting blade.

Tape Gripper

After the unattached tape portion is cut, the remaining unattached tape portion between the tape applicator and the cutting point often has a tendency to curl. The degree of curling depends on how tightly the tape was rolled and the conformability of the tape material. Curling can make it difficult to restart the tape application process. For example, if the tape applicator comprises a tape applicator wheel, the remaining unattached tape portion can curl around the tape applicator wheel and interfere with its ability to apply tape to the material surface. In some disclosed embodiments, the remaining unattached tape portion is prevented from curling.

Some disclosed embodiments of the tape application device comprise a tape gripper configured to grip the remaining unattached tape portion. The tape gripper is useful for preventing the remaining unattached tape portion from curling around the tape applicator wheel during intermittent operation. The tape gripper also is useful for staging the system and holding the tape in a straight line. Typically, the tape gripper is located between the tape applicator and the tape cutter along the flow direction. Like the tape cutter, the tape gripper can be positioned to be adjacent to the unattached tape portion. For example, when the tape applicator moves away from the material surface, the unattached tape portion can contact the tape gripper. The unattached tape portion can be held by a gripping block, which can be a structure of any form that is capable of contacting and holding the unattached tape portion. Several mechanisms can be used to grip the tape, such as pinching mechanisms and vacuum mechanisms. In some disclosed embodiments, when the tape applicator is moved away from the material surface, the unattached tape portion extends between a first block and a second block on the tape gripper. The first block, the second block, or both can be movably mounted to grip the unattached tape portion. The gripping action can be actuated, for example, by a solenoid, a hydraulic device, a pneumatic device, a linear actuator or a piston. Some tape grippers that grip by a pinching mechanism, comprise gripping pads positioned to contact the tape. The gripping pads can be any pads that enhance the gripping action of the tape gripper. In some disclosed embodiments, the gripping pads are made of a material that enhances friction, such as rubber or a rubber-like substance.

In some disclosed embodiments, the tape gripper facilitates the operation of the tape cutter. Tape cutters that comprise a cutting blade that moves across the path of the tape can be less reliable when the tape does not resist the motion of the cutting blade. Gripping the tape can increase this resistance and prevent the tape from merely yielding or folding back in response to the motion of the cutting blade. In some disclosed embodiments, the action of the tape gripper enables the tape cutter to cut tape that is held with little or no tension, such as tape held at less than 1 kilogram of tension or tape that has some slack.

The proximity of the tape gripper to the tape cutter can affect the ability of the tape gripper to facilitate the operation of the tape cutter. Gripping the tape closer to the tape cutter increases the degree to which the tape will resist the motion of the cutting blade. In some disclosed embodiments, the unattached tape portion is gripped at a gripping site and cut at a cutting point and the gripping site is substantially adjacent to the cutting point.

Figure 7:
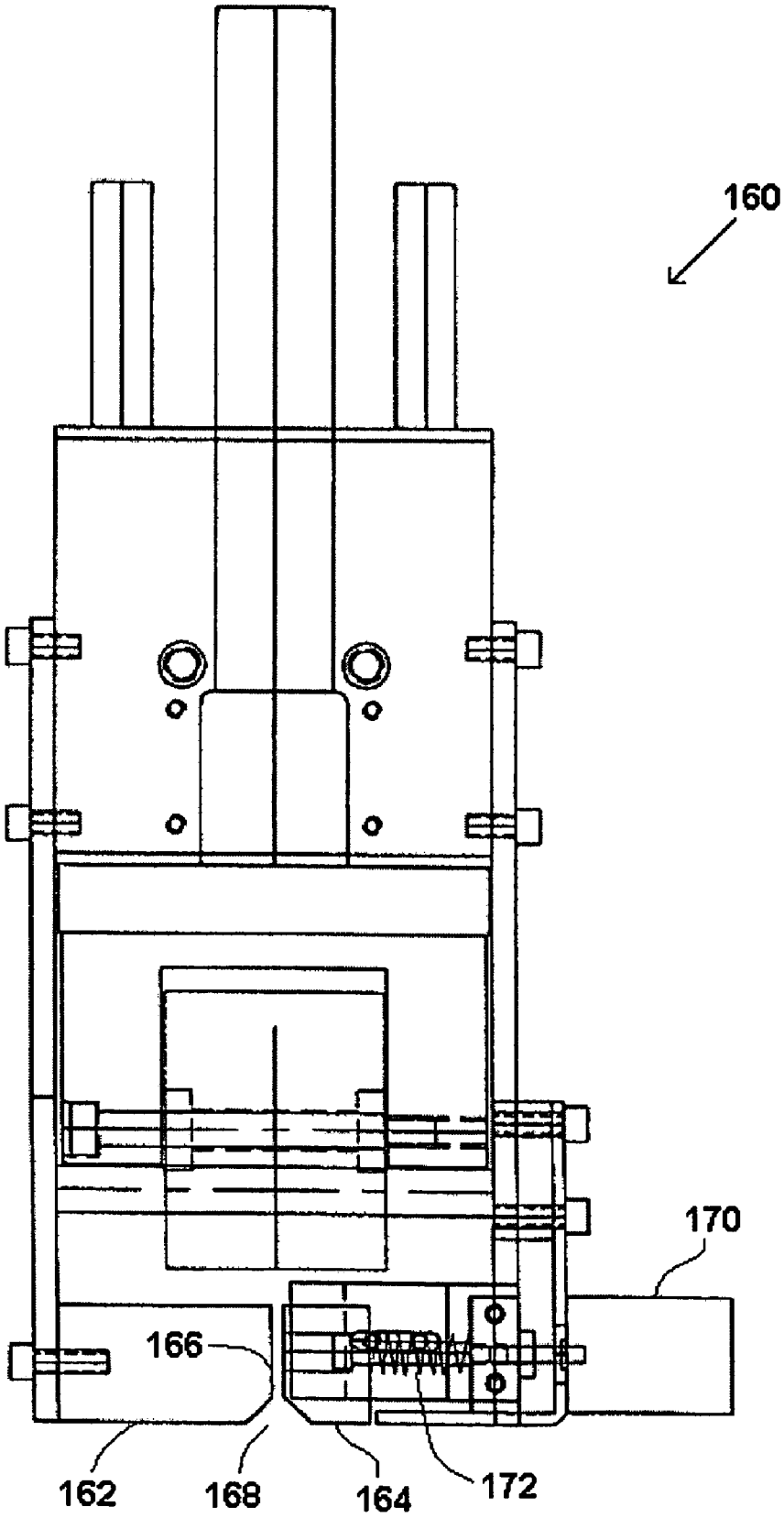
FIG. 7 is a cross section view of one example of a tape gripper.

FIG. 7 illustrates one example of a tape gripper 160. A stationary block 162 and a movable block 164 are separated by an opening 166. The opening 166 has a wide mouth 168. The tape gripper 160 can be installed on a tape application device so that when the tape applicator rises, the unattached tape portion will extend into the opening 166. The wide mouth 168 helps to guide the unattached tape portion into the opening 166. Once positioned in the opening 166, the unattached tape portion can be gripped by actuating a gripper piston 170. The gripper piston 170 causes the movable block 164 to press against the stationary block 162. The unattached tape portion is held in place between the movable block 164 and the stationary block 162. A spring 172 promotes an evenly-distributed application of pressure.

In some disclosed embodiments, the tape gripper is combined with the tape cutter in a single housing. The tape gripper and the tape cutter also can be configured to operate with a single actuator so that the tape gripper grips the tape just before the tape cutter cuts the tape. For example, the combined tape cutter and tape gripper can comprise a fixed block, a movable block, a cutting blade and a piston, with the cutting blade and the movable block both attached to the piston. The cutting blade can be slightly recessed relative to the surface of the movable block so that the surface of the movable block engages the tape before the cutting blade engages the tape. When the piston is actuated, the movable block presses the tape against the fixed block. The movable block can be mounted so that it will remain fixed against the fixed block while the cutting blade extends into the path of the tape. After the tape is cut, the remaining unattached tape portion can be held between the fixed block and the movable block until the tape application device signals the movable block to retract. In some disclosed embodiments, when the tape applicator is moved away from the material surface, the unattached tape portion extends between the fixed block and the movable block.

Figure 8:
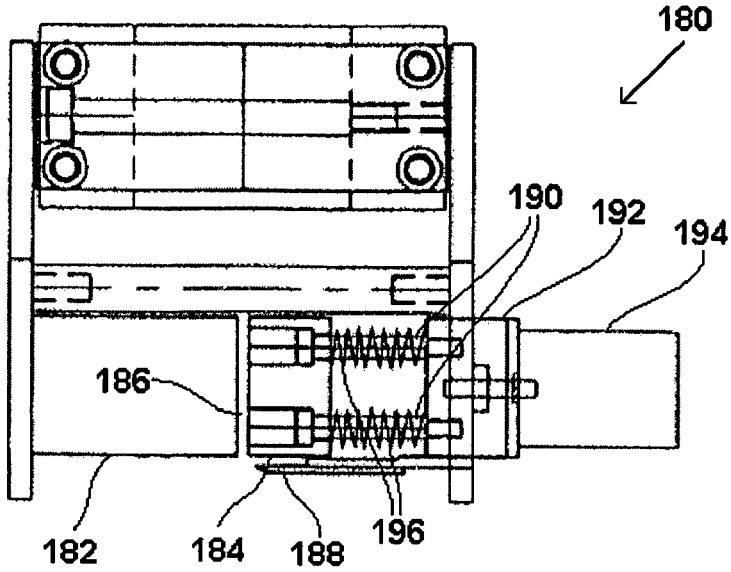
FIG. 8 is a cross section view of one example of a combined tape cutter and tape gripper.

FIG. 8 illustrates an example of a combined tape cutter and tape gripper 180. The combined tape cutter and tape gripper comprises a stationary block 182 and a movable block 184. An opening 186 is created between the stationary block 182 and the movable block 184 for receiving the unattached tape portion. A cutting blade 188 is positioned below the movable block 184. The movable block 184 is held in position by two guide screws 190 attached to a piston block 192. The piston block 192 is attached to a cutter/gripper piston 194. Each guide screw 190 has a compression spring 196 around its circumference. This arrangement gives the movable block 184 a spring loaded linear motion. When the cutter/gripper piston 194 is actuated, the movable block 184 first presses the unattached tape portion against the fixed block 182. As the piston block 192 extends further, the movable block 184 remains fixed and exerts more pressure on the fixed block 182 due to compression of the springs 196. Meanwhile, the cutting blade 188, which is attached directly to the piston block 192, continues to extend and cuts the unattached tape portion. The unattached tape portion will remain gripped between the movable block 184 and the fixed block 182 until the cutter/gripper piston 194 is released.

Figure 9:
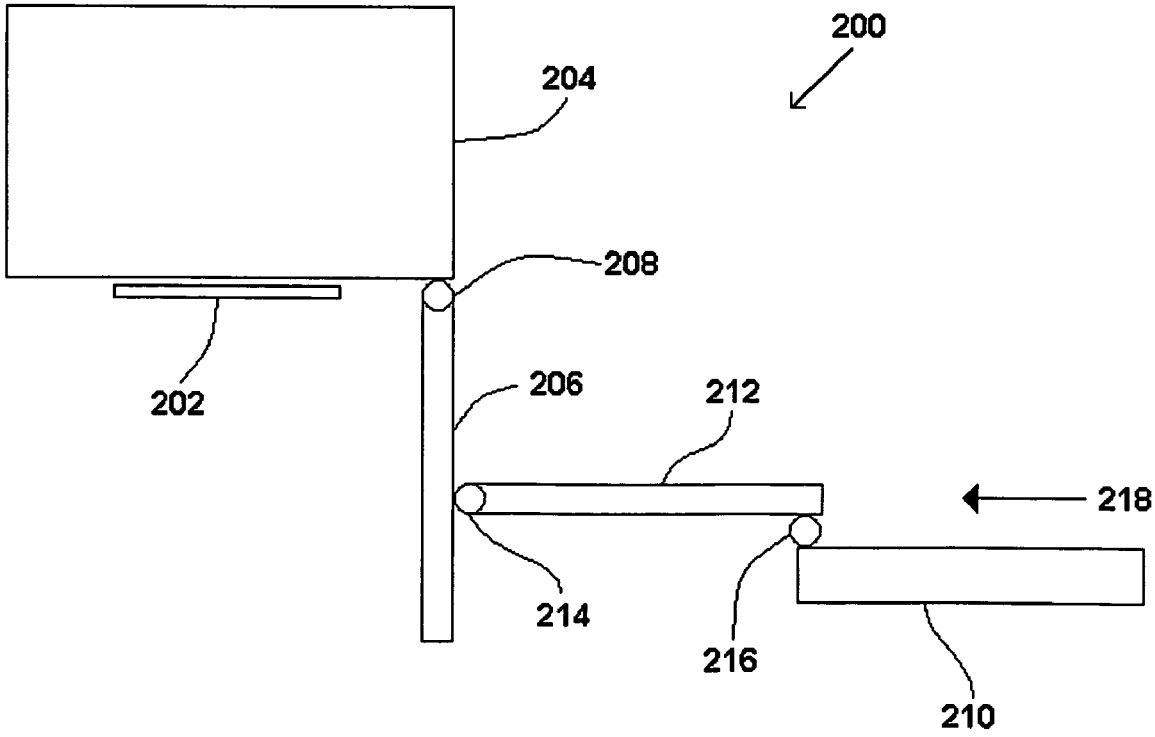
FIG. 9 is a side elevation view of another example of a tape gripper.

Another variation of the tape gripper is illustrated in FIG. 9. In the illustrated tape gripper 200, the tape 202 to be gripped is positioned below a block 204. A flap 206 is attached to the block 204 by a hinge 208. A side-mounted piston 210 applies pressure to the flap 206 via an arm 212. The arm 212 is connected to the flap 206 and the side-mounted piston 210 with hinges 214 and 216, respectively. When the side-mounted piston 210 extends in a direction 218, the flap 206 presses against the block 204 and grips the tape 202. A blade can be attached to flap 206 to perform cutting by a swinging motion. Tape grippers that grip the tape with a hinged flap, such as the tape gripper illustrated in FIG. 9, are well-suited for gripping flat tapes, such as flat tapes with widths greater than about 1 centimeter or less than about 6 centimeters.

Engagement-Initiation Press

Also to facilitate intermittent operation, some disclosed embodiments comprise an engagement-initiation press. The engagement-initiation press can be positioned, for example, between the tape applicator and the tape cutter or between the tape applicator and the tape gripper. The engagement-initiation press can be any device capable of bonding the tape to the material surface, such as rolling devices, pneumatic devices and devices that attach the tape with a jet of air. In some embodiments, the engagement-initiation press comprises an engagement-initiation press wheel configured to roll along the material surface. The engagement-initiation press can be movable relative to the material surface by the action of a second lift. Like the first lift, the second lift can be any device capable of moving the engagement-initiation press, including solenoids, hydraulic devices, pneumatic devices, a linear actuators and pistons. The second lift also can be a combination of two or more devices with one designated for moving the engagement-initiation press toward the material surface and one designated for moving the engagement-initiation press away from the material surface.

The engagement-initiation press is useful for restarting tape application, such as after a gap has passed. First, the second lift is signaled to move the engagement-initiation press toward the material surface. As it moves, the engagement-initiation press will contact the remaining unattached tape portion and press it against the material surface. This prevents the remaining unattached tape portion from curling around the tape applicator wheel. In some disclosed embodiments, the engagement-initiation press has a heated surface that heat-activates the tape. In other disclosed embodiments, the engagement-initiation press in not heated. Depending on the type of tape used and whether or not the engagement-initiation press is heated, the engagement-initiation press either bonds a portion of the remaining unattached tape portion to the material surface or merely holds it down. Once the tape applicator has applied a small length of tape to the material surface, the tape will be prevented from curling around the tape applicator wheel. At this point, the engagement-initiation press can be moved away from the material surface by the second lift. The length of tape that must be bonded to the material surface to prevent curling depends on the adhesion between the tape and the material surface. This length can be any length sufficient to counteract the tendency of the tape to curl, such as a length varying from about 1 centimeter to about 30 centimeters, typically from about 2 centimeters to about 20 centimeters and even more typically from about 3 centimeters to about 15 centimeters.

In disclosed embodiments that do not comprise a tape gripper, the engagement-initiation press can be used to prevent curling as soon as the unattached tape portion is cut. For example, the engagement-initiation press can be positioned to block the path of the remaining unattached tape portion as it curls. Once blocked, the curl in the remaining unattached tape portion will hold it in place against the engagement-initiation press until tape application is restarted. The engagement-initiation press can have an engagement-initiation press wheel with a smaller diameter than the tape applicator wheel. Since the remaining unattached tape portion contacts a relatively small surface, any adhesion between the tape and the engagement-initiation press wheel is not likely to interfere with the adhesion between the tape and the material surface. Like the tape applicator wheel, the engagement-initiation press wheel can have a surface comprising a smooth, non-porous material with a low affinity for the adhesives in the tape. As with the tape applicator wheel, the engagement-initiation press can be in alignment with some manner of support, such that the sheets of material are held between the engagement-initiation press and the support when the engagement-initiation press engages the material surface.

Figure 10:
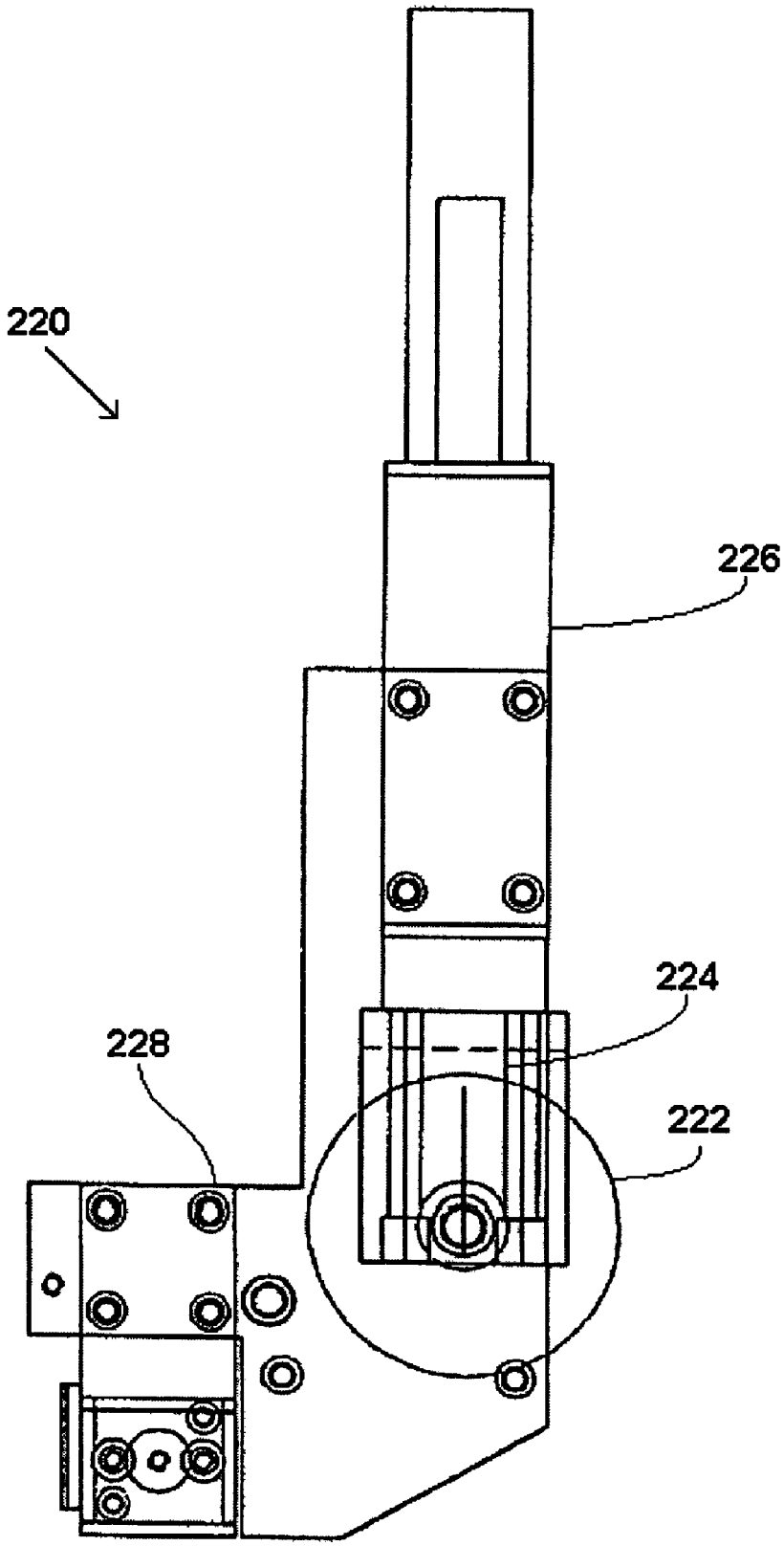
FIG. 10 is a cross section view of one example of an engagement-initiation press.

FIG. 10 illustrates one example of an engagement-initiation press. The illustrated engagement-initiation press 220 comprises an engagement-initiation press wheel 222 mounted on an engagement-initiation press piston 224 within a housing 226. The engagement-initiation press wheel 222 can be forced downward or lifted upward by the engagement-initiation press piston 224. A side plate 228 can be used to mount the housing 226 to a frame. The tape cutter and/or tape gripper also can be mounted to the side plate 228. When the restarting sequence begins, the engagement-initiation press piston 224 drives the engagement-initiation press wheel 222 onto the material surface. Once tape application has resumed, the engagement-initiation press piston 224 retracts and pulls the engagement-initiation press wheel 222 away from the material surface.

Coordinated Process

Gap processing steps will be described to illustrate the coordinated process. Of course, other variations of the process are possible, including intermittent processes that do not involve gaps. During gap processing, a signal from a sensor indicating the beginning of a gap between sheets of material triggers a termination sequence and a signal from the sensor indicating the ending of the gap triggers a restarting sequence. The termination sequence can include signaling the first lift to move the tape applicator away from the material surface. Then, once the unattached tape portion has been formed, the tape cutter can be signaled to cut the unattached tape portion and the tape gripper, if present, can be signaled to grip the unattached tape portion. After the unattached tape portion has been cut, the remaining unattached tape portion typically is gripped by the tape gripper.

Figure 11A:
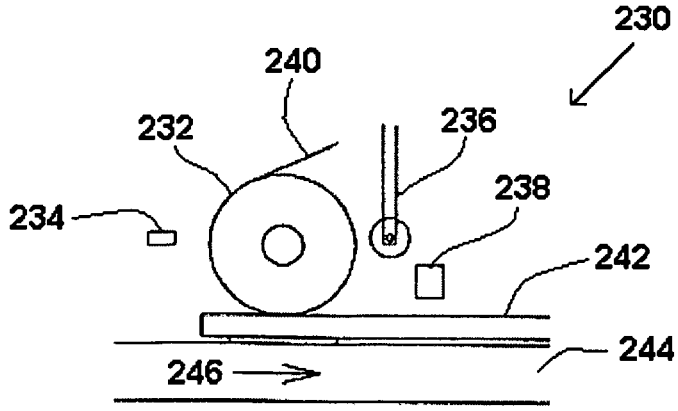
FIGS. 11A-C are side elevation views depicting the steps in the termination sequence of one embodiment of the disclosed method.
Figure 11B:
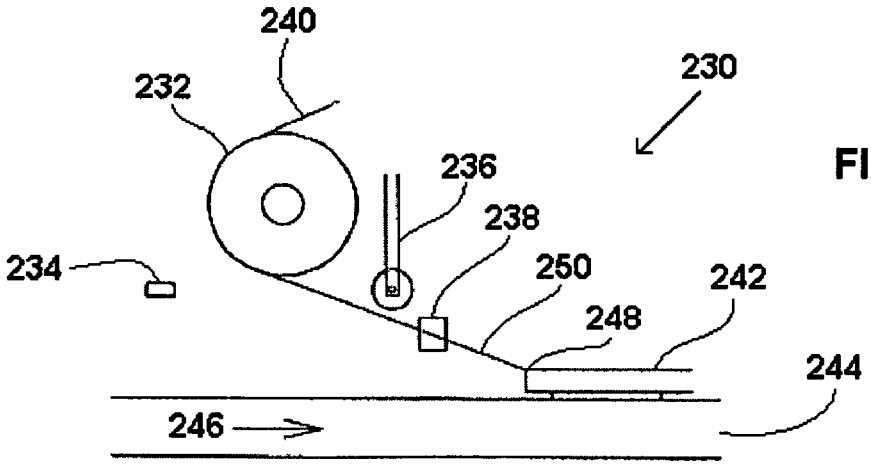
Figure 11C:
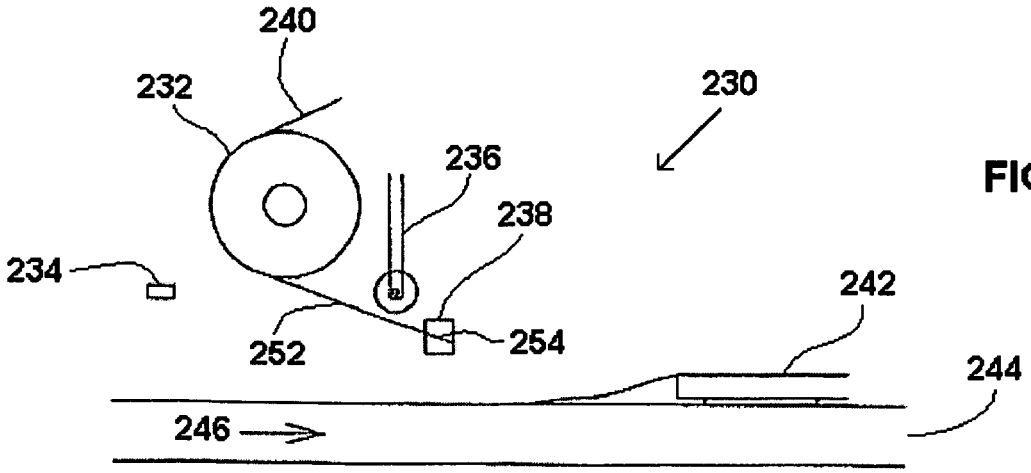

FIGS. 11A-C illustrate one example of the termination sequence in the context of gap processing. The reference numbers in FIGS. 11A-C are consistent. FIGS. 11A-C show a tape application device 230 comprising a tape applicator wheel 232, a sensor 234, an engagement-initiation press 236 and a combined tape cutter and tape gripper 238. In FIG. 11A, the tape applicator wheel 232 is shown rolling tape 240 onto a first sheet of material 242 while the first sheet of material 242 is moving on a conveyor 244 in a flow direction 246. The sensor 234 detects a gap behind the first sheet of material 242 and signals the tape applicator wheel 232 to lift away from the first sheet of material 242. FIG. 11B shows the tape applicator wheel 232 in a lifted position. The tape 240 is attached to the first sheet of material 242 at a final connection point 248. An unattached tape portion 250 extends from the tape applicator wheel 232 to the final connection point 248. Along this path, the unattached tape portion 250 contacts the combined tape cutter and tape gripper 238. FIG. 11C shows the end of the termination sequence, after the unattached tape portion 250 has been cut by the combined tape cutter and tape gripper 238. A remaining unattached tape portion 252 extends from the tape applicator wheel 232 to the combined tape cutter and tape gripper 238. An end 254 of the remaining unattached tape portion 252 is held by the combined tape cutter and tape gripper 238.

The restarting sequence can include signaling the first and second lifts to move the tape applicator and the engagement-initiation press, respectively, toward the material surface. These signals can be timed so that the tape applicator engages the material surface at about the same time or after the engagement-initiation press engages the material surface. If a tape gripper is present, it can be signaled to release the tape at about the same time or after the engagement-initiation press engages the material surface. Once the threat of harmful curling is gone, such as at about the same time or after the tape applicator engages the material surface, the second lift can be signaled to move the engagement-initiation press away from the material surface.

Figure 12A:
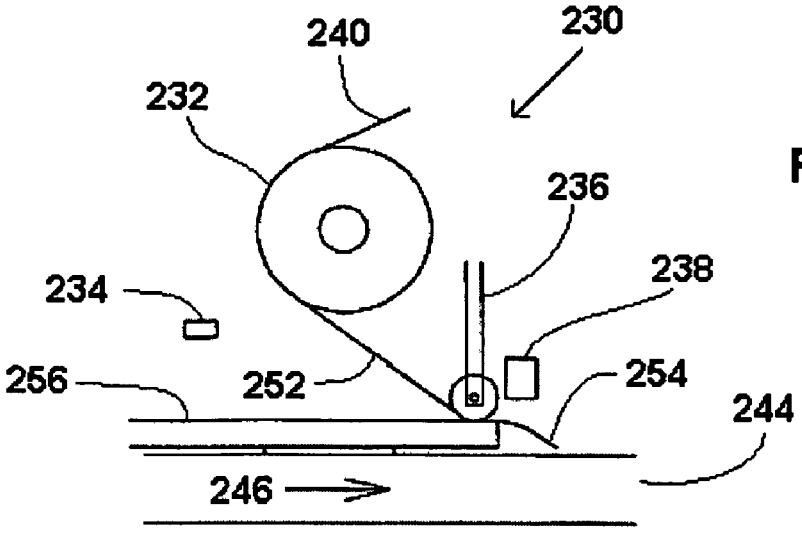
FIGS. 12A-C are side elevation views depicting the steps in the restarting sequence of one embodiment of the disclosed method.
Figure 12B:
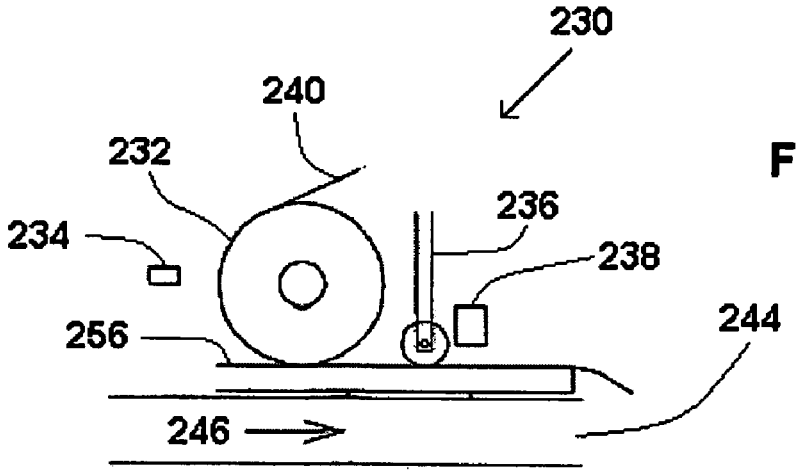
Figure 12C:
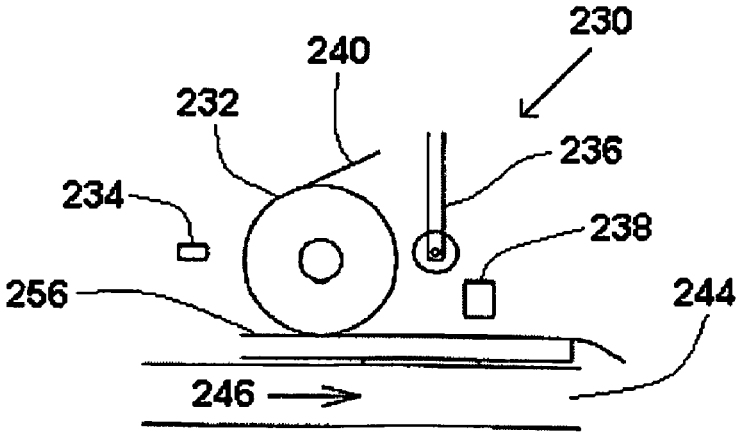

FIGS. 12A-C illustrate one example of the restarting sequence in the context of gap processing. The reference numbers in FIGS. 12A-C correspond to the reference numbers in FIGS. 11A-C. Beginning from the configuration illustrated in FIG. 11C, when the sensor 234 detects a second sheet of material 256, the engagement-initiation press 236 is lowered. As it lowers, the engagement-initiation press 236 pushes the remaining unattached tape portion 252 toward the second sheet of material 256. Once the engagement-initiation press 236 has engaged the second sheet of material 256, the combined tape cutter and tape gripper 238 releases the end 254 of the remaining unattached tape portion 252. FIG. 12A shows the stage in the restarting sequence after the engagement-initiation press 236 has engaged the second sheet of material 256 and the combined tape cutter and tape gripper 238 has released the end 254 of the remaining unattached tape portion 252. As illustrated in FIG. 12B, the tape applicator wheel 232 then lowers into engagement with the second sheet of material 256. The tape applicator wheel 232 is allowed to bond a portion of the length of tape 240 to the second sheet of material 256 and then, as shown in FIG. 12C, the engagement-initiation press 236 is raised.

In addition to the termination sequence and the restarting sequence, the disclosed tape application device can be configured to have other operational modes. For example, after being shut down, the tape application device can be set up in a staging mode. Some disclosed embodiments are staged by stringing tape around the tape applicator wheel and holding the tape in place with the tape gripper. Heated tape applicator wheels often require some time to reach operating temperatures. Once the tape application device is staged and ready, the process can be initiated, for example, by pressing a start button. Some disclosed embodiments, upon initiation, are configured to detect whether there is a sheet of material under the sensor. If so, the device will begin the restarting sequence. If no sheet of material is present under the sensor, the device will remain in the staged mode until the leading edge of a sheet of material is detected.

Figure 13A:
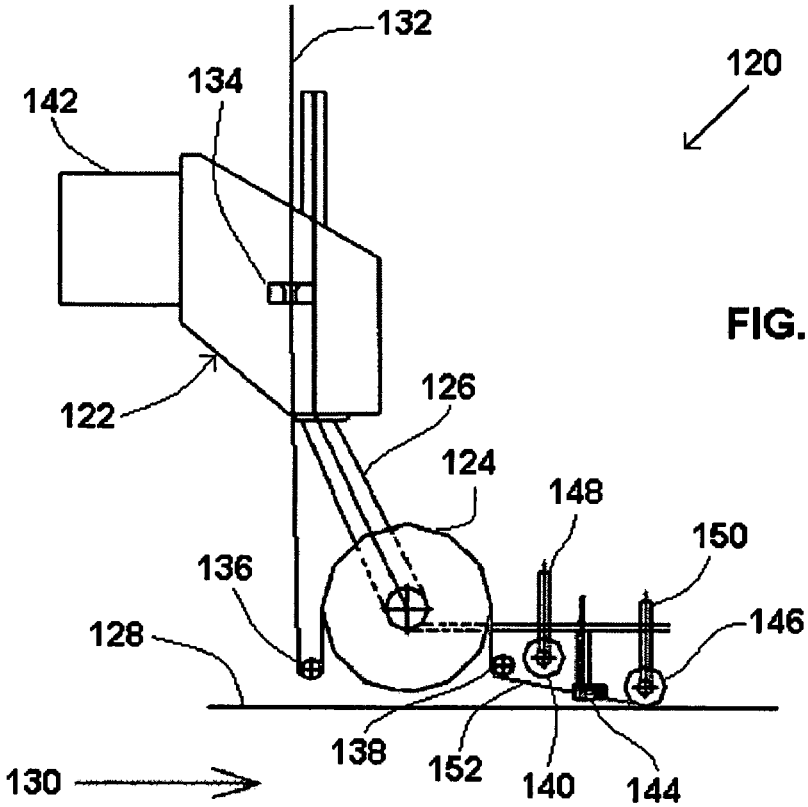
FIGS. 13A-B are side elevation views showing two stages in the intermittent operation of the tape application device illustrated in FIG. 6.
Figure 13B:
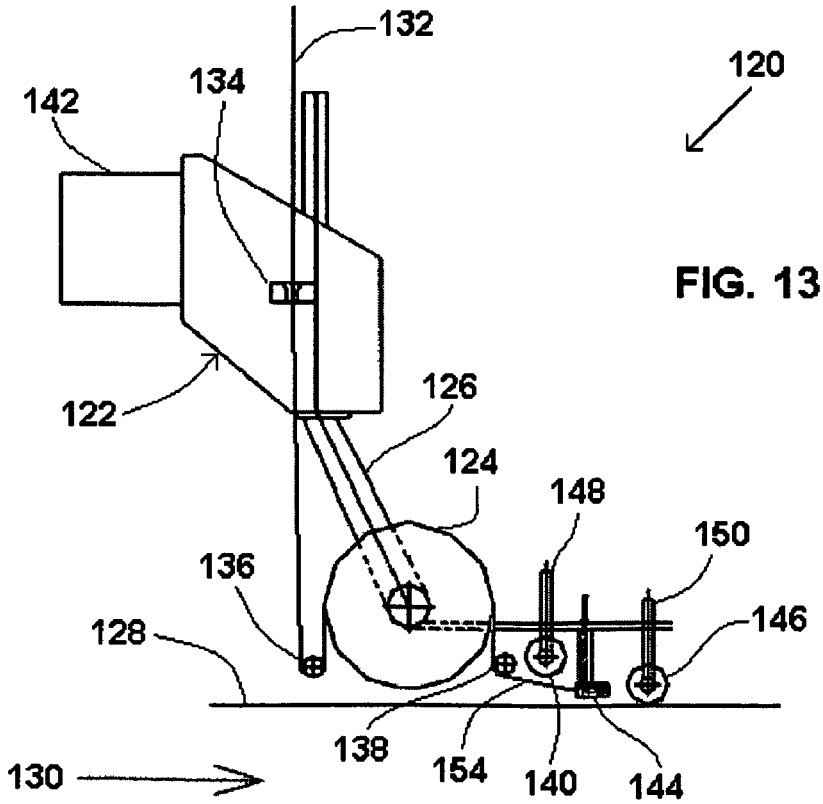

The intermittent operation of the embodiment illustrated in FIG. 6 is slightly different than the intermittent operation of embodiments similar to the embodiment illustrated in FIG. 5. FIGS. 13A and 13B show the tape application device illustrated in FIG. 6 in two stages of intermittent operation in the context of gap processing. The reference numbers used in FIG. 6 are repeated in FIGS. 13A and 13B. When a gap is detected, the first pressing wheel 140 raises and the second pressing wheel 146 lowers. This causes an unattached tape portion 152 to extend between the second pulley 138 and the second pressing wheel 146. The unattached tape portion 152 also extends though the combined tape cutter and tape gripper 144. The combined tape cutter and tape gripper 144 cuts and grips the unattached tape portion 152 leaving a remaining unattached tape portion 154. The second pressing wheel 146 ensures that the part of the unattached tape portion 152 downstream of the combined tape cutter and tape gripper 144 is attached to the material surface 128. Once this portion is attached, the second pressing wheel 146 raises from the material surface 128. When the gap has passed, the first pressing wheel 140 lowers and the combined tape cutter and tape gripper 144 releases the remaining unattached tape portion 154. The tape application device then returns to the configuration shown in FIG. 6.

Preventing Overlap

Some disclosed embodiments of the tape application device are capable of preventing the sheets of material from overlapping or becoming skewed as tape is applied. This can be done, for example, with a hold-down portion. The hold-down portion can be any feature capable of holding down the sheets of material as they pass under the tape applicator. When held down, the sheets of material are less likely to overlap or becoming skewed as tape is applied. This is partially due to increased friction that counteracts the drag force applied by the tape applicator. In addition, when held down, the adjacent sheets of material are flattened between the conveyor and the hold-down portion, which increases edge-to-edge contact.

In order to hold the sheets of material in place, the hold-down portion typically contacts the sheets of material. For example, in some disclosed embodiments, the hold-down portion engages the sheets of material with one or more pressing portions. It is helpful to hold down the sheets of material near the point at which the tape is applied. In some disclosed embodiments comprising a first pressing portion and a second pressing portion, the first and second pressing portions are spaced apart on each side of the tape applicator along a line generally perpendicular to the flow direction.

The manner in which the pressing portions contact the material surface can affect the performance of the hold-down portion. In some disclosed embodiments, at least one of the pressing portions defines a flat bottom surface configured to be placed in slidable engagement with the material surface. Stationary pressing portions, however, can create additional drag force acting against the motion of the sheets of material in the flow direction. This drag force can be minimized, for example, by making the flat bottom surfaces of the pressing portions out of a slick material, such as plastic.

The shape of the pressing portions also affects their interaction with the material surface. In some disclosed embodiments, at least one of the pressing portions has a length more than two times its width and is configured so that its length is generally parallel to the flow direction. Since the drag force applied by the tape applicator generally counteracts the motion of the sheets of material in the flow direction, it is helpful to have additional contact between the sheets of material and the hold-down portion along the flow direction.

It also can be important to minimize the initial drag force on the sheets of material as they enter the hold-down portion, because the sheets of material are not yet secured. Some disclosed embodiments have hold-down portions configured to apply increasing pressure to the sheets of material as they advance along the flow direction. This can be done, for example, by inclining the pressing portions. The pressing portions also can be configured so that they will not become caught on the edges of the sheets of material. For example, in some disclosed embodiments, the pressing portions are inclined upwards or curled upwards at the point where the sheets of material first enter the hold-down portion. In this configuration, the edges of the sheets of material are drawn in by an inclined or convex surface and are less likely to become blocked.

In some disclosed embodiments, at least one of the pressing portions comprises a movable belt configured to be placed in rotatable engagement with the material surface as the sheets of material move in the flow direction. The movement of the belt minimizes the drag force applied to the sheets of material by the pressing portion. A pressing portion comprising a movable belt still is capable, however, of applying pressure to the sheets of material and thereby increasing the friction between the sheets of material and the conveyor. Disclosed embodiments of the hold-down portion in which at least one of the pressing portions comprises a movable belt are especially well suited for joining sheets of material that are lightweight and easily shifted, such as sheets of material with thicknesses less than about 0.5 centimeters, typically less than about 0.4 centimeters, and even more typically less than about 0.3 centimeters.

As mentioned above, the surfaces of the hold down portions preferably are configured to allow movement of the sheets of material in the flow direction with minimal drag and configured to inhibit movement of the sheets of material in directions other than the flow direction. For example, in some disclosed embodiments, the surface of one or more of the pressing portions comprises a series of projections inclined in the flow direction. When the sheets of material move in the flow direction, the material surface is able to slide past the projections. If the sheets of material begin to move in a direction opposite to the flow direction, the projections will dig into the material surface. To adjust the pressure on the sheets of material and to accommodate sheets of material of varying thicknesses, the hold down portion can be flexibly mounted, such as by mounting the hold down portion on springs.

Figure 14:
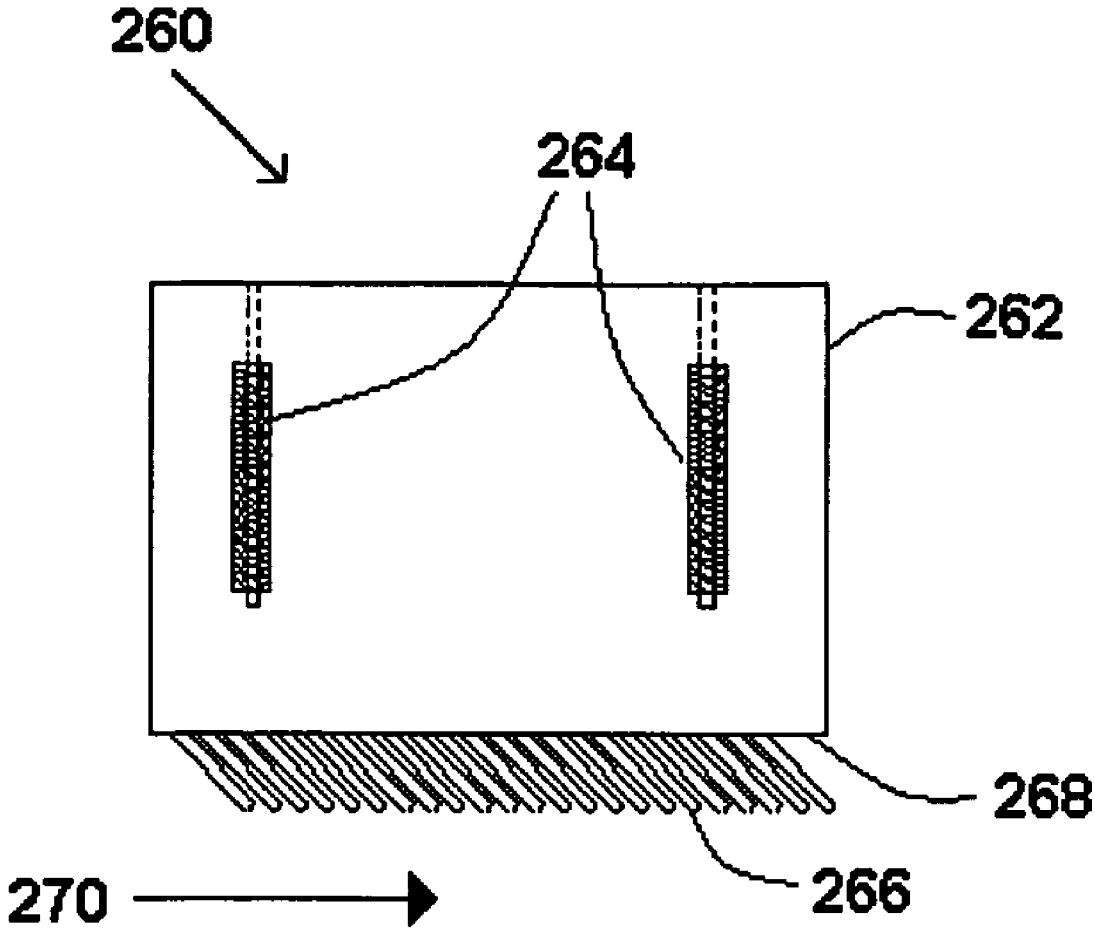
FIG. 14 is a cross section view of part of one example of a hold-down portion.

FIG. 14 illustrates part of a hold down portion configured to allow one-way movement of sheets of material. The hold down portion 260 comprises a body 262. The body 262 is mounted to a frame (not shown) by springs 264. A series of projections 266 are attached to a bottom surface 268 of the body 262 and extend to a material surface of a sheet of material (not shown). As the sheet of material moves in a flow direction 270, the material surface slides past the projections 266. If the sheet of material begins to move in a direction opposite to the flow direction 270, the projections 266 dig into the material surface and stop its motion. The projections 266 can be any projections well-suited for allowing one-way movement. In some disclosed embodiments, the projections are metal or plastic fins with sharp tips. In other disclosed embodiments, the projections are the nap of a textile.

In Use

Disclosed embodiments of the tape application method and device can be used in a variety of processes, including several plywood manufacturing processes. First, as discussed above, some disclosed embodiments can be used to join plywood core pieces edge-to-edge in continuous manufacturing processes. Intermittent tape application allows gaps to be isolated from contiguous portions. In one example, the gaps typically are left in place. In another example, the sheets of material are moved together to create a joint, i.e. the sheets of material are moved together so that they substantially abut one another. Processes for creating such joints commonly are referred to as "crowding processes." In some plywood manufacturing processes, the core pieces are cut into standard size plies. A gap can cause the final ply before the gap to be too short. Intermittent tape application ensures that this short ply will not be attached to the next contiguous portion after the gap. Thus, the short ply can be discarded and new plies can be cut beginning at the front edge of the next contiguous portion. Gaps also can be eliminated by slowing the conveyor in front of the gap until the next contiguous portion advances enough to close the gap.

Plywood typically is manufactured on assembly lines called "spray lines" or "foam lines." Laminated veneer lumber typically is manufactured on "lay-up" assembly lines. In addition to one or more tape application devices, these assembly lines typically comprise a feeding station, where the sheets of material are loaded onto a conveyor. The assembly lines also typically comprise a coating station where a plywood adhesive is applied, such as a curtain station, a spray station or a foam station. One or more tape application devices can be located along the assembly line after the feeding station and before the coating station. Most plywood and laminated veneer lumber manufacturing processes have several of these assembly lines operating simultaneously to produce the various layers of the product. In these processes, one or more tape application devices can be positioned before each coating station.

In the manufacture of plywood core plies, the core pieces have widths perpendicular to the flow direction and lengths parallel to the flow direction. The tape typically is applied along a line generally parallel to the flow direction and generally perpendicular to the edges that run along the widths of the core pieces. In some disclosed embodiments, the tape application device is movable along a direction generally perpendicular to the flow direction so that the line of tape can be applied to different parts of the sheets of material. In addition, multiple lines of tape can be applied by placing multiple tape application devices at different points along the direction generally perpendicular to the flow direction, such as in a linear or staggered configuration. Multiple tape application devices also can be arranged along the flow direction. In some embodiments, one or more tape application devices serve as back-up devices to be engaged when another tape application device runs out of tape or otherwise becomes non-functional. Multiple tape application devices can share certain components, such as a sensor.

For some applications, it is useful to apply tape along a joint between two sheets of material, rather than across the joint. For example, sheets of material can be placed side-by-side on the conveyor so that the joint between the sheets of material runs along the middle of the conveyor and generally parallel to the flow direction. A tape application device positioned in the middle of the conveyor can be configured to apply a strip of tape aligned parallel to the joint such that the width of the tape overlaps the joint. This creates a surprisingly strong bond between the sheets of material because the sheets of material are connected along the entire length of the joint, or at least a substantial portion of the length of the joint.

In still other applications, a strip of tape can be applied along the edge of one or more sheets of material such that part of the width of the tape extends beyond the edge. The tape then can be wrapped around the edge, for example, by pressing the part of the width of the tape extending beyond the edge into contact with the edge. Wrapping tape around the edge of the one or more sheets of material can be useful for a variety of applications. Tape can be used, for example, to strengthen, solidify, smooth out, or otherwise change the properties of the edge of the sheets of material.

In many manufacturing processes, it is useful to join sheets of material in pairs. This process is sometimes referred to as splicing. The disclosed embodiments configured for intermittent tape application are well suited for splicing processes. As discussed above, the tape can be placed along the joints between the sheets of material or across the joints. Intermittent application allows separate pieces of tape to be applied to each joint.

Multi-layer products made with the disclosed tape application device can take many forms. The sheets of material stacked to make these products can be made of a variety of materials, including wood, metal, cardboard and plastic. Thin products can be manufactured by joining thin sheets of material and stacking them in small stacks, such as stacks of 3 or 5 layers. Thicker products can be manufactured by stacking larger numbers of sheets of material or thicker sheets of material. The disclosed method can be used to manufacture plywood products such as laminated veneer lumber, which is strong enough to be used as a structural component building construction. The strength and stability of some plywood products can be improved by placing each layer with the wood grain perpendicular to the wood grain of the adjacent layers. Laminated veneer lumber, however, typically is manufactured with the wood grain of each layer parallel to the wood grain of adjacent layers, which can improve the lumber's load bearing properties.

Although this disclosure primarily has been focused on manufacturing processes for the production of multi-layer products, the disclosed tape application device is well-suited for virtually any automated process that involves tape application. Tape application, for example, is an important step in the manufacture of many cardboard products, such as cardboard packaging products. The disclosed tape application device is completely scalable to accommodate cardboard pieces, which typically are smaller in size than plywood pieces. The speed of the tape application process and the force applied by the various components of the tape application device on the material being processed also can be adjusted to accommodate different types of material.

Closing

Having illustrated and described the principles of the invention in exemplary embodiments, it should be apparent to those skilled in the art that the illustrative embodiments can be modified in arrangement and detail without departing from such principles. In view of the many possible embodiments to which the principles of the invention can be applied, it should be understood that the illustrative embodiments are intended to teach these principles and are not intended to be a limitation on the scope of the invention. We therefore claim as our invention all that comes within the scope and spirit of the following claims and their equivalents.

We claim:

1. A device for the intermittent application of tape to a material surface of one or more sheets of material moving in a flow direction, comprising:

a controller configured to control the device during automatic operation;

a tape applicator configured to apply tape to the material surface along a line generally parallel to the flow direction as the one or more sheets of material move in the flow direction;

a tape cutter;

a first lift for moving the tape applicator away from the material surface, where moving the tape applicator away from the material surface after applying a first portion of tape to the material surface causes an unattached tape portion to extend between the tape applicator and a final connection point on the material surface, and the tape cutter is configured to cut the unattached tape portion at a cutting point; and a tape gripper configured to grip the unattached tape portion at a gripping site between the cutting point and the tape applicator.

2. The device of claim 1, where the tape cutter comprises a cutting blade and the cutting blade is at least partially serrated.

3. The device of claim 1, further comprising a sensor to detect at least a first location related to the position of the one or more sheets of material.

4. The device of claim 1, where the controller is configured to signal the first lift to move the tape applicator away from the material surface, configured to signal the tape gripper to grip the unattached tape portion after signaling the first lift to move the tape applicator away from the material surface, and configured to signal the tape cutter to cut the unattached tape portion after signaling the tape gripper to grip the unattached tape portion.

5. The device of claim 1, where the tape cutter comprises a cutting blade, the tape gripper comprises a movable block and a fixed block, the movable block and the cutting blade are attached to a linear actuator, and the movable block is configured to press the unattached tape portion against the fixed block while the cutting blade extends across the unattached tape portion.

6. The device of claim 5, where the movable block is connected to the linear actuator by a resilient member and the cutting blade is connected to the linear actuator by a substantially fixed member.

7. The device of claim 6, where the movable block has an engagement side that presses against the fixed block, the cutting blade has a cutting edge that cuts the unattached tape portion, the linear actuator moves the movable block and the cutting blade in an actuating direction, the cutting edge of the cutting blade is recessed relative to the engagement side of the movable block in the actuating direction before the movable block engages the fixed block, and the cutting edge of the cutting blade protrudes relative to the engagement side of the movable block in the actuating direction after the movable block engages the fixed block.

8. The device of claim 1, where the tape applicator comprises a tape applicator wheel configured to press the tape into engagement with the material surface.

9. The device of claim 8, where the tape applicator wheel comprises a heater to heat-activate the tape.

10. The device of claim 1, configured for the intermittent application of tape to a material surface of two or more sheets of material moving in the flow direction, and further comprising a sensor positioned to detect gaps between the two or more sheets of material as the two or more sheets of material move in the flow direction.

11. The device of claim 10, where the controller is configured to receive a first signal from the sensor detecting a beginning of a gap between two of the two or more sheets of material, configured to receive a second signal from the sensor detecting an ending of the gap, configured to signal the first lift to move the tape applicator away from the material surface after receiving the first signal, and configured to signal the first lift to move the tape applicator toward the material surface after receiving the second signal.

12. The device of claim 1, further comprising:

an engagement-initiation press positioned along the flow direction between the tape applicator and the tape cutter; and a second lift for moving the engagement-initiation press toward and away from the material surface.

13. The device of claim 12, where the controller is configured to signal the first lift to move the tape applicator away from the material surface, configured to signal the tape cutter to cut the tape after signaling the first lift to move the tape applicator away from the material surface, and configured to signal the first lift to move the tape applicator toward the material surface and the second lift to move the engagement-initiation press toward the material surface after signaling to restart tape application.

14. The device of claim 13, where the controller is configured to signal the tape gripper to grip the unattached tape portion after signaling the first lift to move the tape applicator away from the material surface and before signaling the second lift to move the engagement-initiation press toward the material surface.

15. The device of claim 1, further comprising a hold-down portion for inhibiting movement of the one or more sheets of material in at least one direction other than the flow direction during application of tape to the material surface, where the hold-down portion comprises one or more pressing portions.

16. The device of claim 15, where the hold-down portion comprises a first pressing portion and a second pressing portion, and the first and second pressing portions are positioned on opposite sides of the tape applicator along a line generally perpendicular to the flow direction.

17. The device of claim 15, where at least one of the one or more pressing portions comprises a belt configured to be placed in rotatable engagement with the material surface.

18. The device of claim 15, where at least one of the one or more pressing portions comprises one or more projections inclined relative to the material surface and configured to inhibit movement of the one or more sheets of material in at least one direction other than the flow direction.

19. The device of claim 15, where at least one of the one or more pressing portions defines a flat bottom surface configured to be placed in slidable engagement with the material surface.

20. The device of claim 19, where at least one of the one or more pressing portions with a flat bottom surface configured to be placed in slidable engagement with the material surface is configured to be inclined relative to the material surface, such that the at least one of the one or more pressing portions applies increasing pressure to a point on the material surface as the one or more sheets of material move in the flow direction.

21. A device for the intermittent application of tape to a material surface of one or more sheets of material moving in a flow direction, comprising:

a tape applicator;

a tape cutter positioned downstream from the tape applicator in the flow direction;

an engagement-initiation press positioned between the tape applicator and the tape cutter in the flow direction; and a first lift for moving the tape applicator toward and away from the material surface.

22. The device of claim 21, further comprising a controller configured to control the device during automatic operation.

23. The device of claim 21, where the tape cutter comprises a cutting blade and the cutting blade is at least partially serrated.

24. The device of claim 21, further comprising a sensor to detect at least a first location related to the position of the one or more sheets of material.

25. The device of claim 21, where the tape applicator comprises a tape applicator wheel configured to press the tape into engagement with the material surface.

26. The device of claim 25, where the tape applicator wheel comprises a heater to heat-activate the tape.

27. The device of claim 21, further comprising a second lift for moving the engagement-initiation press toward and away from the material surface.

28. The device of claim 27, further comprising a controller, where the controller is configured to signal the first lift to move the tape applicator away from the material surface, configured to signal the tape cutter to cut the tape after signaling the first lift to move the tape applicator away from the material surface, and configured to signal the first lift to move the tape applicator toward the material surface and the second lift to move the engagement-initiation press toward the material surface after signaling to restart tape application.

29. The device of claim 21, configured for the intermittent application of tape to a material surface of two or more sheets of material moving in the flow direction, and further comprising a sensor positioned to detect gaps between the two or more sheets of material as the two or more sheets of material move in the flow direction.

30. The device of claim 21, further comprising a hold-down portion for inhibiting movement of the one or more sheets of material in at least one direction other than the flow direction during application of tape to the material surface, where the hold-down portion comprises one or more pressing portions.

31. The device of claim 30, where the hold-down portion comprises a first pressing portion and a second pressing portion, and the first and second pressing portions are positioned on opposite sides of the tape applicator along a line generally perpendicular to the flow direction.

32. The device of claim 30, where at least one pressing portion is configured to hold-down the sheets of material in an application area around an application point at which the tape applicator engages the material surface and at least one pressing portion is configured to hold down the sheets of material in an engagement-initiation area around an engagement-initiation point at which the engagement-initiation press engages the material surface.

33. The device of claim 30, where at least one of the one or more pressing portions comprises a belt configured to be placed in rotatable engagement with the material surface.

34. The device of claim 30, where at least one of the one or more pressing portions comprises one or more projections inclined relative to the material surface and configured to inhibit movement of the one or more sheets of material in at least one direction other than the flow direction.

35. The device of claim 30, where at least one of the one or more pressing portions defines a flat bottom surface configured to be placed in slidable engagement with the material surface.

36. The device of claim 35, where at least one of the one or more pressing portions with a flat bottom surface configured to be placed in slidable engagement with the material surface is configured to be inclined relative to the material surface, such that the at least one of the one or more pressing portions applies increasing pressure to a point on the material surface as the one or more sheets of material move in the flow direction.

37. A device for the intermittent application of tape to a material surface of one or more sheets of material moving in a flow direction, comprising:

a tape applicator;

a tape cutter positioned downstream from the tape applicator in the flow direction;

an engagement-initiation press positioned between the tape applicator and the tape cutter in the flow direction; and a tape gripper positioned between the engagement-initiation press and the tape cutter in the flow direction.

38. A method for intermittently applying tape to a material surface of one or more sheets of material moving in a flow direction, comprising:

applying tape to the material surface along a line generally parallel to the flow direction with a tape applicator;

moving the tape applicator away from the material surface, such that an unattached tape portion extends between the tape applicator and a final connection point on the material surface;

gripping the unattached tape portion at a gripping site;

cutting the unattached tape portion at a cutting point between the gripping site and the final connection point; and restarting tape application after cutting the unattached tape portion, where restarting the tape application comprises moving the tape applicator toward the material surface.

39. The method of claim 38, where applying tape to the material surface comprises applying tape at a first location on the material surface and then applying tape at a second location on the material surface.

40. The method of claim 38, where restarting tape application further comprises moving an engagement-initiation press toward the unattached tape portion so as to attach a first point of the unattached tape portion to the material surface.

41. The method of claim 38, where gripping the unattached tape portion at a gripping site comprises squeezing the unattached tape portion between a first block and a second block, and moving the tape applicator away from the material surface causes the gripping site to position itself between the first block and the second block.

42. The method of claim 38, further comprising holding down the one or more sheets of material in an application area around an application point at which the tape applicator engages the material surface.

43. The method of claim 42, where holding down the one or more sheets of material comprises engaging the material surface with one or more pressing portions, such that at least one of the one or more pressing portions is in slidable or rotatable engagement with the material surface while the tape applicator is in engagement with the material surface.

44. The method of claim 43, further comprising inhibiting movement of the one or more sheets of material in at least one direction other than the flow direction by engaging the material surface with one or more projections inclined relative to the material surface.

45. A method for intermittently applying tape to a material surface of one or more sheets of material moving in a flow direction, comprising:

applying tape to the material surface along a line generally parallel to the flow direction with a tape applicator;

moving the tape applicator away from the material surface, such that an unattached tape portion extends between the tape applicator and a final connection point on the material surface;

cutting the unattached tape portion;

restarting tape application after cutting the unattached tape portion, where restarting the tape application comprises moving an engagement-initiation press toward the unattached tape portion so as to attach a first point of the unattached tape portion to the material surface; and holding down the one or more sheets of material in an application area around an application point at which the tape applicator engages the material surface.

46. The method of claim 45, further comprising holding down the one or more sheets of material in an engagement-initiation area around an engagement-initiation point at which the engagement-initiation press engages the material surface.

47. The method of claim 45, where holding down the one or more sheets of material comprises engaging the material surface with one or more pressing portions, such that at least one of the one or more pressing portions is in slidable or rotatable engagement with the material surface while the tape applicator is in engagement with the material surface.

48. The method of claim 45, further comprising inhibiting movement of the one or more sheets of material in at least one direction other than the flow direction by engaging the material surface with one or more projections inclined relative to the material surface.

49. A method for joining sheets of material, comprising:

moving a plurality of separate sheets of material along a flow direction to form a line-up with a material surface, where the line-up comprises two or more contiguous portions and one or more gaps between the two or more contiguous portions, and each contiguous portion comprises at least two sheets of material having edges substantially abutting one another edge-to-edge; and intermittently applying tape to the material surface as the line-up moves in the flow direction such that a strip of tape connects the sheets of material in at least one of the two or more contiguous portions, where intermittently applying tape to the material surface comprises:

connecting the tape to a first surface of a first contiguous portion with a tape applicator;

sensing a beginning of a first gap;

moving the tape applicator away from the first surface after sensing the beginning of the first gap, such that an unattached tape portion extends between the tape applicator and a final connection point on the first surface; and cutting the unattached tape portion.

50. The method of claim 49, where the unattached tape portion is cut at a cutting point and intermittently applying tape to the material surface further comprises gripping the unattached tape portion at a gripping site between the cutting point and the tape applicator.

51. The method of claim 49, where intermittently applying tape to the material surface further comprises:

sensing an ending of the first gap;

moving an engagement-initiation press toward the unattached tape portion so as to attach a first point of the unattached tape portion to a second surface of a second contiguous portion;

moving the tape applicator into engagement with the second surface at about the same time or after the engagement-initiation press engages the second surface; and moving the engagement-initiation press away from the second surface at about the same time or after moving the tape applicator into engagement with the second surface.

52. The method of claim 51, where the unattached tape portion is cut at a cutting point and intermittently applying tape to the material surface further comprises:

gripping the unattached tape portion at a gripping site between the cutting point and the tape applicator; and releasing the unattached tape portion at the gripping site at about the same time or after the engagement-initiation press engages the second surface.

53. A method for cutting tape during the application of tape to a material surface of one or more sheets of material moving in a flow direction, comprising:

applying tape to the material surface along a line generally parallel to the flow direction with a tape applicator;

forming an unattached tape portion between the tape applicator and a final connection point on the material surface;

gripping the unattached tape portion at a gripping site; and cutting the unattached tape portion at a cutting point after gripping the unattached tape portion at the gripping site, where the cutting point is between the gripping site and the final connection point, and the unattached tape portion is held under little or no tension when it is cut.

54. The method of claim 53, where the cutting point is substantially adjacent to the gripping site.

55. The method of claim 53, where gripping the unattached tape portion comprises contacting the unattached tape portion with a gripping block and cutting the unattached tape portion comprises contacting the unattached tape portion with a cutting blade, and further comprising retracting the gripping block relative to a cutting edge of the cutting blade after gripping the unattached tape portion.

* * * * *